US011060379B2

(12) United States Patent
Garcia

(10) Patent No.: US 11,060,379 B2
(45) Date of Patent: Jul. 13, 2021

(54) CASING SCRAPER ACTIVATED AND DEACTIVATED DOWNHOLE

(71) Applicant: WEATHERFORD TECHNOLOGY HOLDINGS, LLC, Houston, TX (US)

(72) Inventor: Matthew D. Garcia, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/604,010

(22) PCT Filed: Jun. 9, 2017

(86) PCT No.: PCT/US2017/036691

§ 371 (c)(1),
(2) Date: Oct. 9, 2019

(87) PCT Pub. No.: WO2018/226237

PCT Pub. Date: Dec. 13, 2018

(65) Prior Publication Data

US 2020/0080400 A1 Mar. 12, 2020

(51) Int. Cl.
*E21B 37/04* (2006.01)
*E21B 23/00* (2006.01)

(52) U.S. Cl.
CPC ..... *E21B 37/04* (2013.01); *E21B 23/006* (2013.01)

(58) Field of Classification Search
CPC ..... E21B 37/04; E21B 37/02; E21B 23/006
See application file for complete search history.

(56) References Cited

U.S. PATENT DOCUMENTS 5,351,758 A * 10/1994 Henderson ..... E21B 10/322 166/174
7,311,141 B2 12/2007 Tulloch et al.
(Continued)

FOREIGN PATENT DOCUMENTS

WO 2016010716 A1 1/2016

OTHER PUBLICATIONS

Weathrford; "P37479 9-5/8" Switchable Scraper, company powerpoint presentation, dated 2014, 44 pages.
(Continued)

*Primary Examiner* — Brad Harcourt
(74) *Attorney, Agent, or Firm* — Smith IP Services, P.C.

(57) ABSTRACT

A casing scraper can include extendable scraper elements, and an actuator that extends the scraper elements after the actuator retracts the scraper elements. The actuator extends the scraper elements and retracts the scraper elements after application of respective pressure differentials in a well. A method of operating a casing scraper can include extending scraper elements into contact with an interior surface of a casing after a predetermined pressure differential is applied without obstructing an interior flow passage, and then retracting the scraper elements after another predetermined pressure differential is applied. A well system can include a casing scraper with one or more extendable scraper elements, and an actuator that operates in response to manipulation of pressure differentials. The actuator operates the casing scraper only after at least a predetermined pressure differential has been applied for at least a predetermined period of time.

19 Claims, 30 Drawing Sheets

(56) References Cited

U.S. PATENT DOCUMENTS

| | | | | |
|---|---|---|---|---|
| 8,141,627 | B2 * | 3/2012 | Krieg | E21B 37/02 166/172 |
| 8,408,307 | B2 | 4/2013 | Telfer | |
| 9,404,329 | B2 | 8/2016 | Meeks | |
| 9,435,176 | B2 | 9/2016 | Bansal et al. | |
| 10,041,333 | B2 * | 8/2018 | Hern | E21B 37/02 |
| 2007/0089912 | A1 | 4/2007 | Eddison et al. | |
| 2009/0025927 | A1 * | 1/2009 | Telfer | E21B 37/02 166/174 |
| 2011/0214873 | A1 | 9/2011 | Krieg et al. | |
| 2013/0133949 | A1 | 5/2013 | Xu et al. | |
| 2014/0116712 | A1 | 5/2014 | Bansal et al. | |

OTHER PUBLICATIONS

International Search Report with Written Opinion dated Mar. 6, 2018 for PCT Patent Application No. PCT/US2017/036691, 17 pages.

Weatherford; "Ball Drop", descriptive illustration, dated Feb. 1, 2017, 1 page.

ODTJELL Well Services; "DrillRdill Drilling Scraper", OWS Wellbore clean-up technology, Performance Report, dated Jul. 2014, 4 pages.

MI SWACO; "Switchback Scraper", Versatile casing cleaning tool, company article No. 16-MI-155924, dated 2016, 1 page.

Weatherford; CLEARMAX TOL/PBR Scraper, Tech Specs, company article No. 11535.00, dated 2010-2015, 1 page.

* cited by examiner

CASING SCRAPER ACTIVATED AND DEACTIVATED DOWNHOLE

CROSS-REFERENCE TO RELATED APPLICATION

This application is a national stage under 35 USC 371 of International Application No. PCT/US17/36691, filed on 9 Jun. 2017. The entire disclosure of this prior application is incorporated herein by this reference.

TECHNICAL FIELD

This disclosure relates generally to equipment utilized and operations performed in conjunction with a subterranean well and, in one example described below, more particularly provides a casing scraper and techniques for activating, deactivating and reactivating the casing scraper downhole.

BACKGROUND

A casing scraper can be used to clean an interior of a casing string for various purposes, and at different times during well construction, workover and other operations. For example, after cementing a casing string in a well, a casing scraper may be used to remove any cement remaining in an interior of the casing string. As another example, a casing scraper may be used to clean a section of a casing string in which a packer, liner hanger or other tool needs a relatively clean interior surface to grip or seal against.

Therefore, it will be appreciated that improvements are continually needed in the arts of constructing and operating casing scrapers in wells. Such improvements could be used in a variety of different operations in which it is desired to clean an interior surface of a tubular in a well.

DETAILED DESCRIPTION

Figure 1:
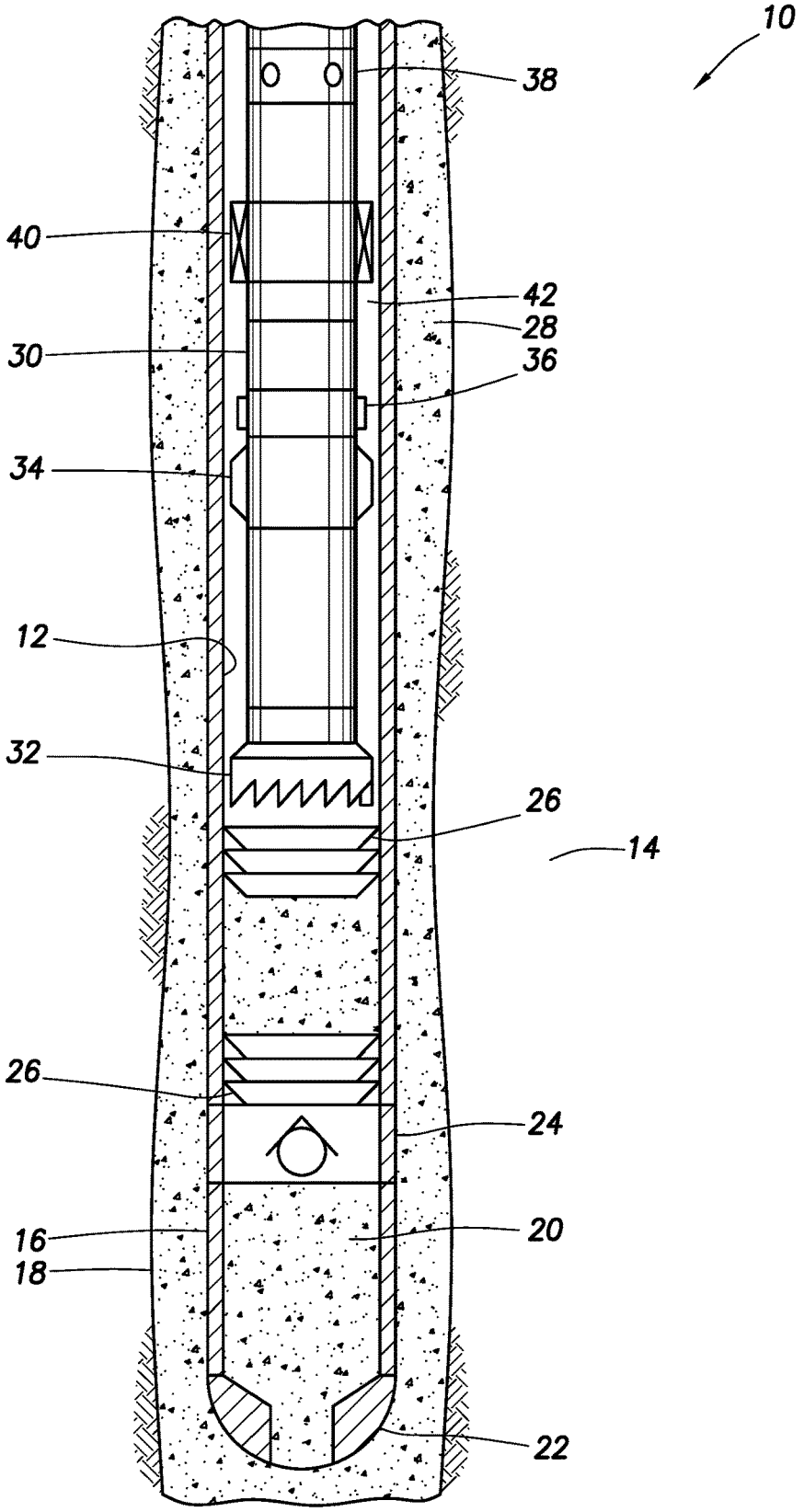
FIG. 1 is a representative partially cross-sectional view of an example of a well system and associated method which can embody principles of this disclosure.

Representatively illustrated in FIG. 1 is a system 10 for use with a well, and an associated method, which system and method can embody the principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into an earth formation 14, and the wellbore 12 has been lined with casing 16 and cement 18. As depicted in FIG. 1, the wellbore 12 is generally vertical, but the principles of this disclosure can be readily applied in situations where a wellbore is generally horizontal or otherwise inclined relative to vertical.

The term "casing" is used herein to refer to a protective wellbore lining. Casing may be provided as tubulars known to those skilled in the art as casing, liner, tubing or other forms of pipe. Casing may be segmented or continuous, and made be made of any materials. Casing may be formed in situ. Thus, the scope of this disclosure is not limited to use of any particular type of casing.

Returning to the FIG. 1 example, note that some of the cement 18 remains in the casing 16 after a cementing operation in which the cement 18 is flowed into an annulus 28 formed radially between the casing 16 and an inner wall of the formation 14. The cement 18 remaining in the casing 16 is known to those skilled in the art as a "shoe track" 20, since a substantial portion of the cement 18 in the casing 16 will be positioned between a guide shoe 22 and a float shoe 24 in the casing.

It is desired, in the FIG. 1 example, to drill out the shoe track 20, along with the shoes 22, 24, cementing plugs 26 and any other obstructions in the casing 16, so that the wellbore 12 can be extended. In addition, it is desired to thereafter clean out any residual cement in the casing 16.

In other examples, debris, corrosion, scale, sand or other solid or particulate substances may be removed from an interior surface of the casing 16 or other tubular for other purposes. In one example, it may be desired to scrape a section of a casing in which it is intended to set a packer, anchor or liner hanger, in order to provide a suitable sealing and/or gripping interior surface.

To drill out the shoe track 20, a tubular string 30 is conveyed into the wellbore 12, with a cutting tool 32 (such as, a drill bit or a mill) connected at a distal end of the tubular string 30. Such a tubular string would commonly be referred to by those skilled in the art as a "drill string," whether or not a drill bit is actually used.

The tubular string 30 may be comprised of substantially continuous tubing or jointed pipe. Any materials (such as, steel, plastic, composites, etc.) may be used in the tubular string 30.

The cutting tool 32 may be rotated downhole by rotating the tubular string 30 at surface, for example, using a top drive or a rotary table of a rig (not shown) at the surface. In other examples, a fluid motor (such as, a positive displacement Moineau-type mud motor or a drilling turbine, not shown) may be used to rotate the cutting tool 32, without rotating a substantial portion of the tubular string 30.

In the FIG. 1 example, the tubular string 30 includes a casing scraper 34, a magnet 36, a circulating valve 38 and a packer 40 connected therein. However, it should be clearly understood that the scope of this disclosure is not limited to use of any particular tools, configuration of tools or combination of tools in a tubular string.

The scraper 34 removes any remaining debris from an interior of the casing 16 after the cutting tool 32 drills through the shoe track 20, shoes 22, 24 and plugs 26. The magnet 36 retains any ferromagnetic material that displaces into close proximity to the magnet 36. Any number of scrapers 34 and magnets 36 may be used, as desired.

The circulating valve 38 provides for selective communication between an interior of the tubular string 30 and an annulus 42 formed radially between the tubular string and the casing 16. Any suitable commercially available circulating valve may be used for the valve 38, and the valve 38 may be actuated using any appropriate technique (such as, by application of one or more pressure levels to the interior of the tubular string 30 or to the annulus 42). In some examples, the valve 38 may be repeatedly cycled between open and closed configurations.

The packer 40 is used to seal off the annulus 42 and thereby isolate different sections of the annulus 42 from each other. Such isolation can be useful, in the FIG. 1 example, for pressure testing after the shoe track 20 has been drilled out.

Figure 2:
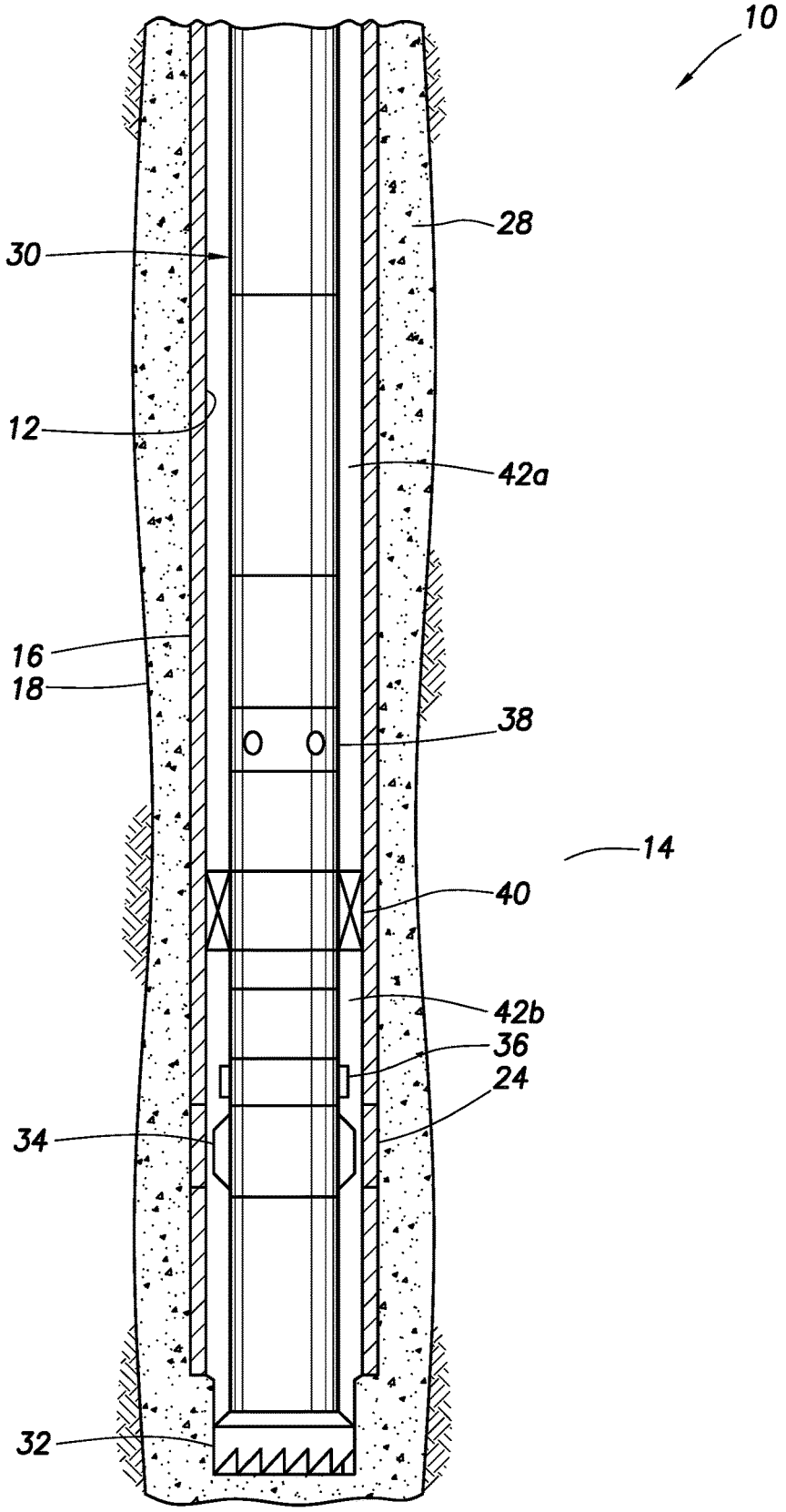
FIG. 2 is a representative partially cross-sectional view of the well system and method, in which a casing shoe track has been drilled out.

Referring additionally now to FIG. 2, the system 10 and method are representatively illustrated after the shoe track 20 (and other obstructions) have been drilled out. For convenience, the cutting tool 32 is depicted in FIG. 2 as being positioned just beyond the distal end of the casing 16, but in actual practice the cutting tool 32 may be used to drill a substantial distance beyond the casing 16.

As depicted in FIG. 2, the packer 40 is set in the casing 16, thereby isolating sections 42*a,b* of the annulus 42 from each other. Pressure tests may now be performed, for example, by increasing or decreasing pressure in the lower annulus section 42*b* relative to pressure in the formation 14, and monitoring for leakage past the cement 18.

After the pressure tests (if any), the scraper 34 can be used to scrape an interior of the casing 16 as the tubular string 30 is retrieved from the wellbore 12. In this manner, a separate trip is not needed to clean the interior of the casing 16 after drilling out the shoe track 20.

The scraper 34 can be in a deactivated, retracted configuration while the tubular string 30 is tripped into the wellbore 12, and remain in the retracted configuration while drilling out the shoe track 20. After the drilling operation and any pressure tests, the scraper 34 can be activated to its extended configuration, so that the interior of the casing 16 is cleaned as the tubular string 30 is tripped out of the wellbore 12.

If any obstructions (such as, a casing collar with a reduced inner diameter, a casing patch, etc.) are encountered while retrieving the tubular string 30 with the scraper 34 in its extended configuration, the scraper can be returned to its retracted configuration. After passing through the restriction, the scraper 34 can again be placed in its extended configuration, to allow for further scraping of the casing 16 interior surface.

Thus, the scraper 34 may be placed in the retracted configuration to allow for drilling or other rotation of the tubular string 30, to pass through interior restrictions, or for other purposes. The scraper 34 may be placed in the extended configuration to scrape the interior surface of the casing 16, such as, to remove residual cement from the interior surface, to provide an appropriate sealing or gripping surface, or for other purposes.

In examples described more fully below, the scraper 34 can be cycled between its retracted and extended configurations any number of times downhole. The scope of this disclosure is not limited to any particular sequence, order, purpose or number of changes from the extended configuration to the retracted configuration, or from the retracted configuration to the extended configuration.

Referring additionally now to FIGS. 3A-4E, elevational and cross-sectional views are representatively illustrated for an example of the casing scraper 34. Although the casing scraper 34 is suitable for use in the system 10 and method of FIGS. 1 & 2, the casing scraper 34 example of FIGS. 3A-4E may also, or alternatively, be useful in a wide variety of other systems and methods.

Note that the term "casing," used to identify the casing scraper 34, is also used in the broad sense mentioned above. Thus, the casing scraper 34 may be used to clean an interior surface of any type of tubular (such as, casing, liner, tubing, pipe, etc.) in a well. The scope of this disclosure is not limited to use of the casing scraper 34 to scrape or otherwise clean an interior surface of any particular type of tubular in a well.

Figure 3A:
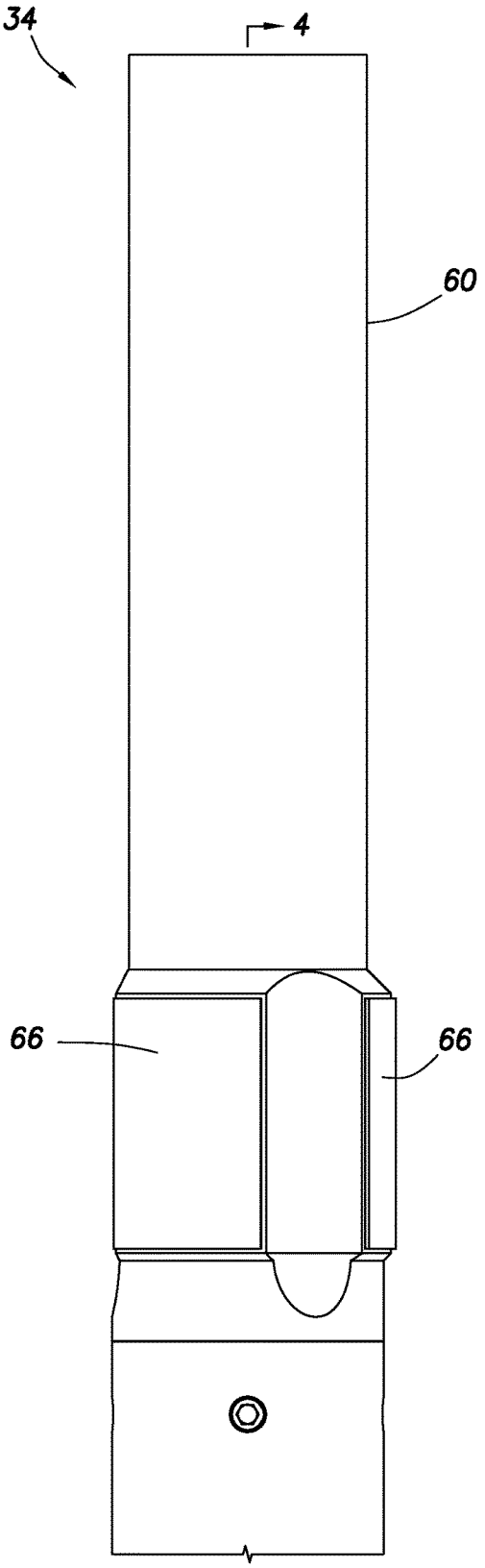
FIGS. 3A-E are representative elevational views of successive longitudinal sections of an example of a casing scraper that can embody the principles of this disclosure.
Figure 3B:
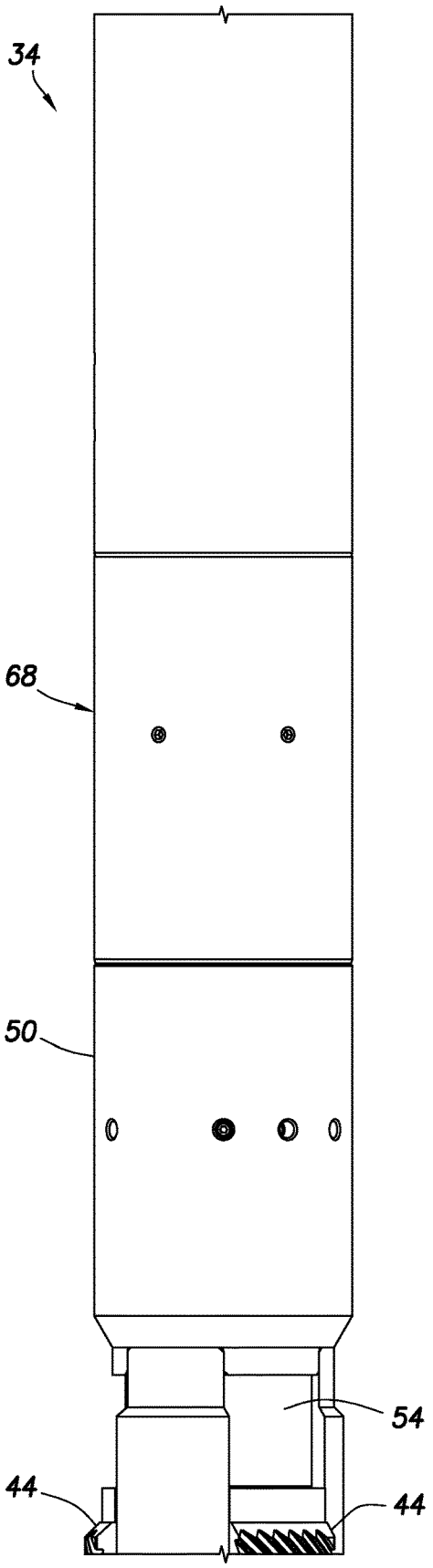
Figure 3C:
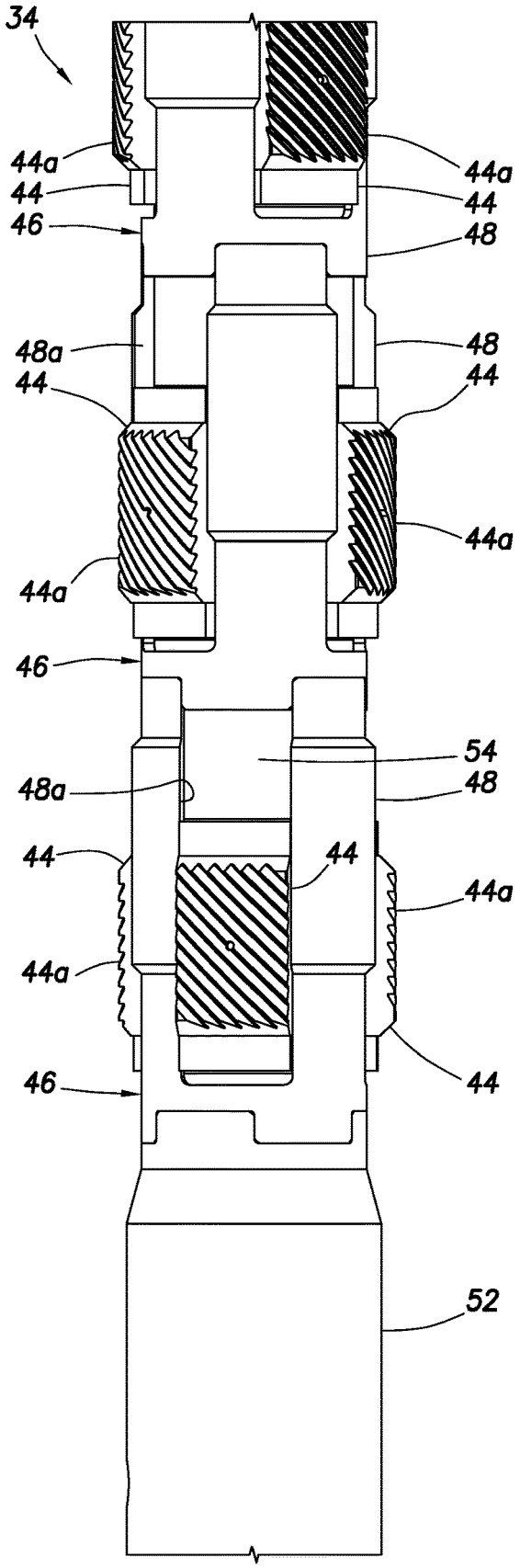
Figure 3D:
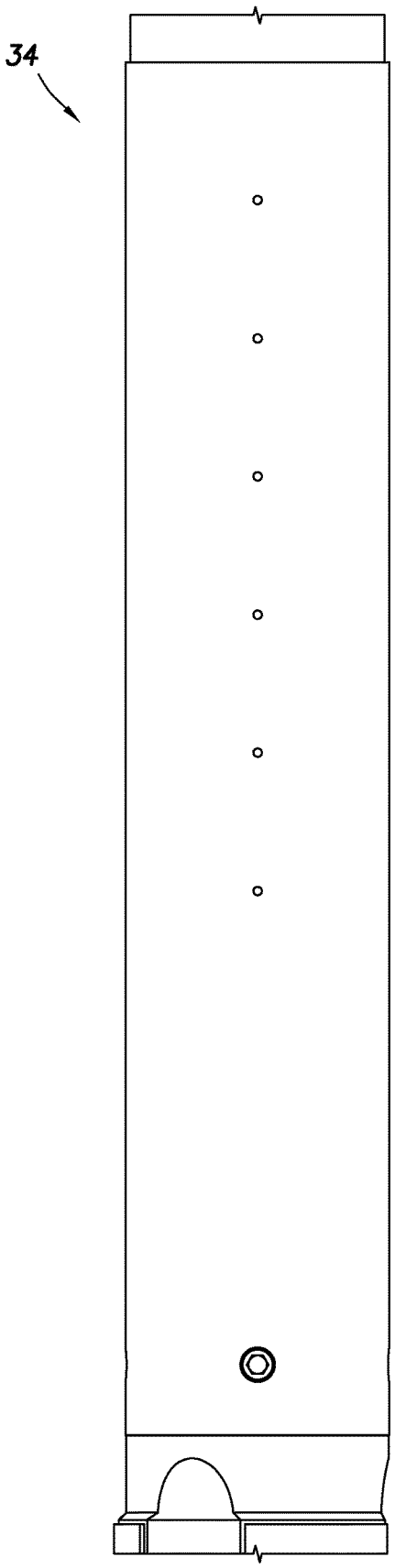
Figure 3E:
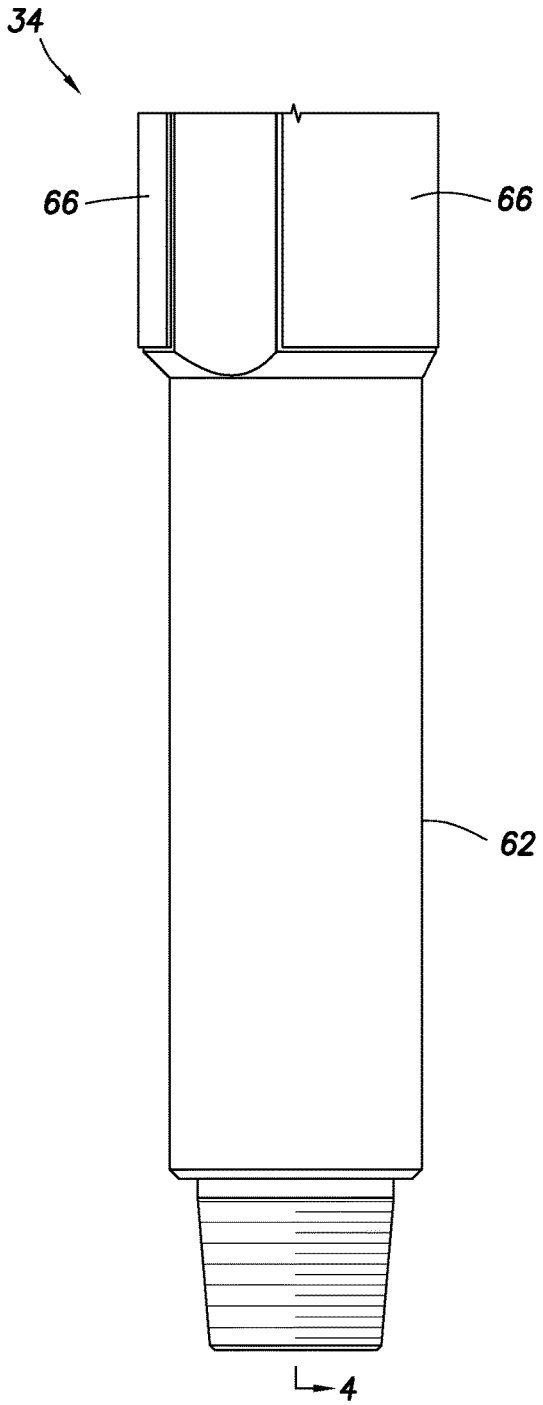
Figure 4A:
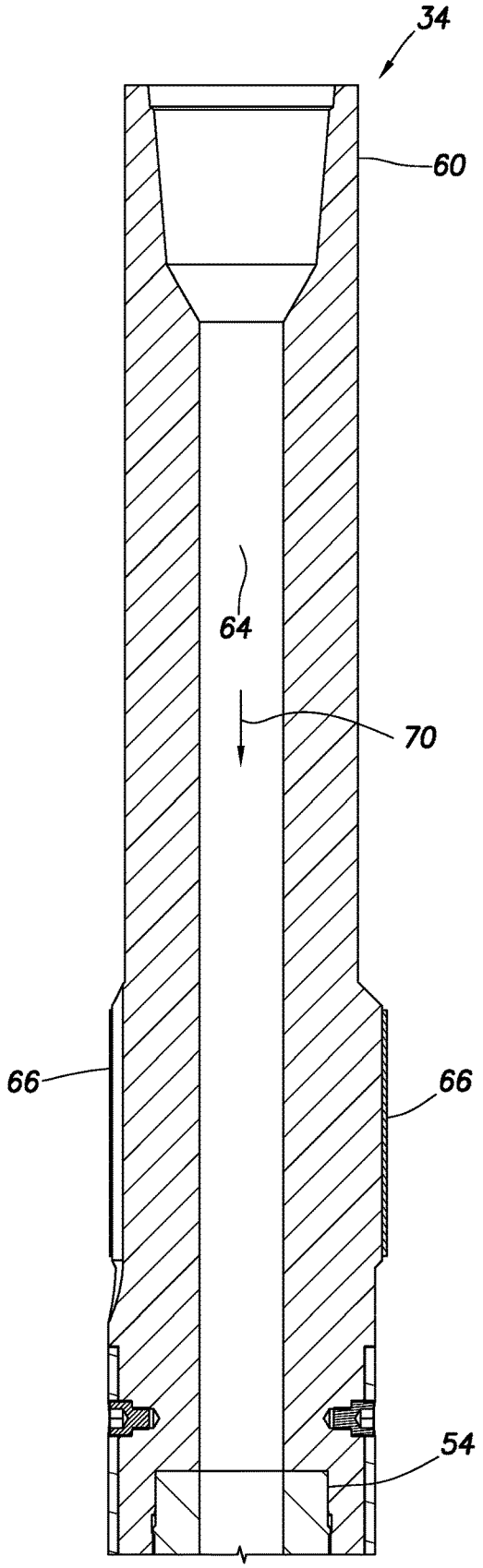
FIGS. 4A-E are representative cross-sectional views of the casing scraper, taken along line 4-4 of FIGS. 3A-E.
Figure 4B:
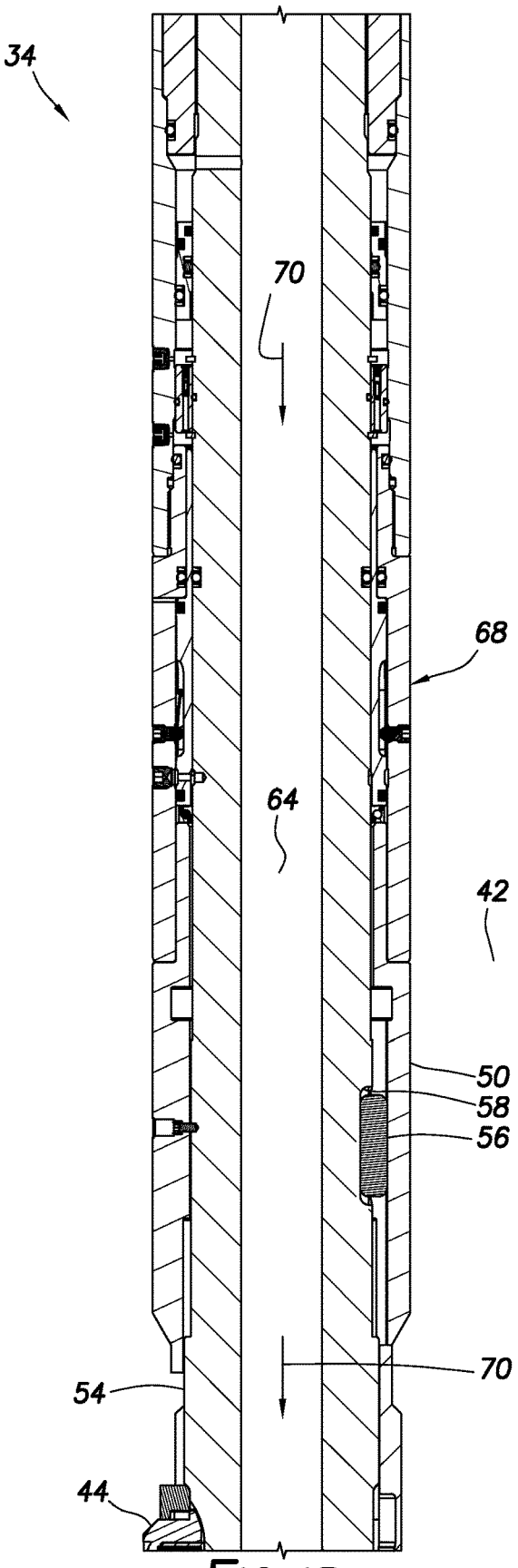
Figure 4C:
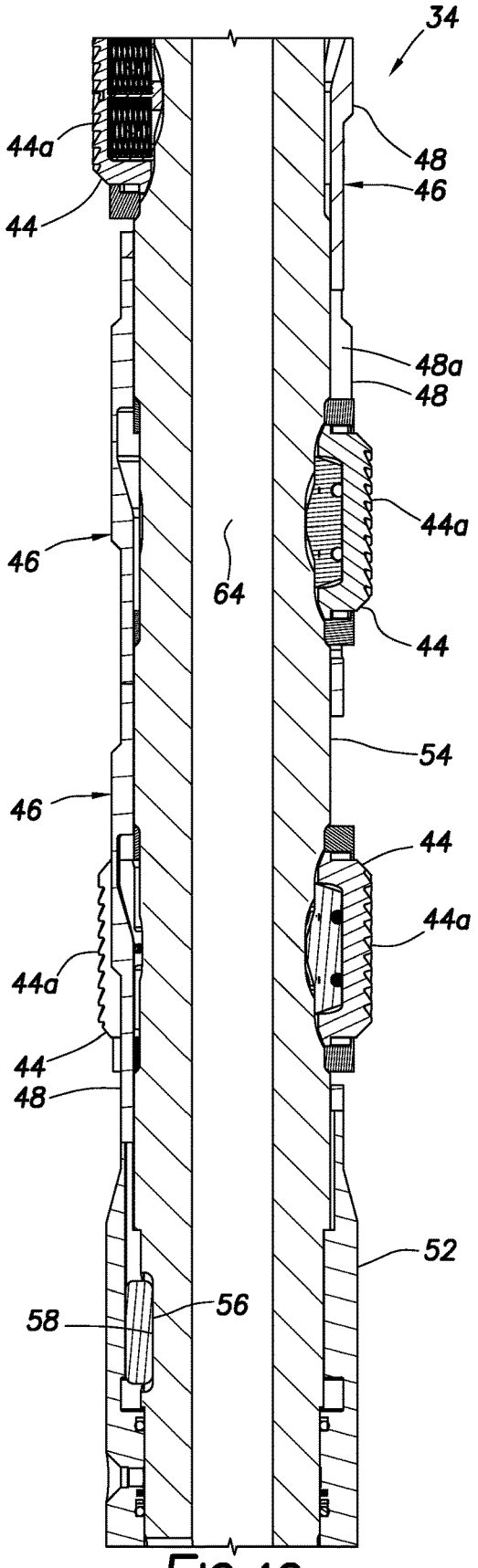
Figure 4D:
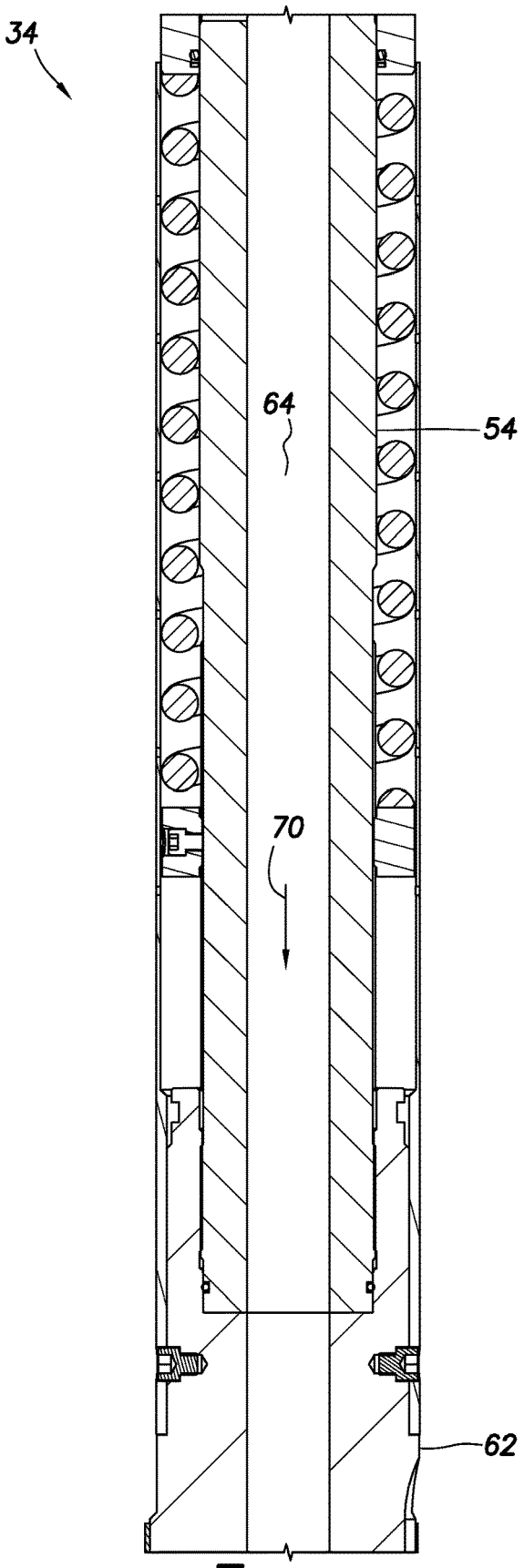
Figure 4E:
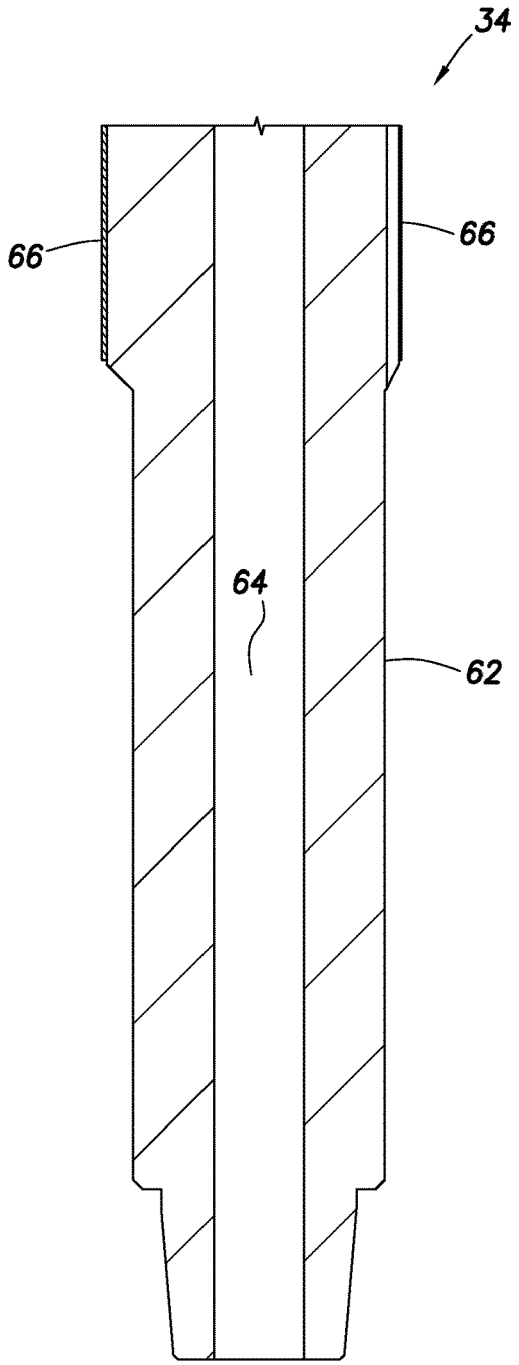

In the FIGS. 3A-4E example, the casing scraper 34 includes multiple scraper elements 44 (see FIGS. 3C & 4C). Each scraper element 44 has an outer cleaning surface 44*a*, so that, when the scraper element is extended (displaced radially outward, in this example), the cleaning surface 44*a* is brought into contact with the interior surface of a tubular in which the casing scraper 34 is positioned.

When used in the system 10 of FIGS. 1 & 2, the casing scraper 34 can be activated to its extended configuration while the shoe track 20 is being drilled out (to clean the interior of the casing 16 of residual cement), after the shoe track has been drilled out (to clean a sealing and gripping section for later placement of a packer, liner hanger, bridge plug, anchor, etc.), or while the tubular string 30 is being retrieved from the well (to prepare the well for subsequent operations).

The scraper elements 44 are arranged on the casing scraper 34 so that, as the casing scraper is displaced longitudinally through a tubular, with the scraper elements 44 extended, the scraper elements will clean the interior surface of the tubular, 360 degrees about the interior surface, without requiring rotation of the casing scraper as it is displaced through the tubular. The scraper elements 44 are circumferentially and longitudinally distributed on the casing scraper 34, in a manner that causes the scraper elements to overlap circumferentially (thereby achieving contact 360 degrees around the tubular interior surface), and also allows for sufficient flow area through the extended scraper elements to mitigate surge or swab effects as the tubular string 30 is displaced through the casing 16 in the FIGS. 1 & 2 example.

The scraper elements 44 as depicted in FIGS. 3B-4C are arranged into individual scraper element modules 46. Each of the modules 46 includes three of the scraper elements 44 equally spaced apart circumferentially about the module. Thus, adjacent scraper elements 44 are spaced apart 120 degrees in each module 46, thereby providing suitable flow area between the scraper elements.

The modules 46 are rotationally oriented with respect to each other, so that the scraper elements 44 of the combined modules overlap fully circumferentially about the casing scraper 34. In this example, adjacent modules 46 are rotationally offset 40 degrees relative to one another. In other examples, other numbers of scraper elements 44 may be provided in each module 46, other numbers of modules may be used, and different spacings and rotational offsets may be used.

Each of the modules 46 also includes a scraper element housing 48. The scraper elements 44 are received in slots 48*a* formed through the housing 48 and spaced apart 120 degrees.

Opposite longitudinal ends of the housings 48 are castellated. This permits the housings 48 to be connected to each other in a manner that provides the desired 40 degree rotational offset (in this example), and secures against relative rotation between adjacent modules 46. Similar castellations are also provided between the modules 46 and outer housing sections 50, 52 on opposite sides of the modules.

The housing sections 50, 52 are secured against rotation relative to an inner generally tubular mandrel 54 by keys 56 (see FIGS. 4B & C) received in slots 58 formed on the mandrel. Thus, the housings 48 and the housing sections 50, 52 are secured against rotation relative to the mandrel 54. However, some longitudinal displacement of the housings 48 and the outer housing sections 50, 52 is permitted, as described more fully below.

End connectors 60, 62 are connected at opposite ends of the mandrel 54. The end connectors 60, 62 are threaded, in this example, for convenient connection in a tubular string (such as, the tubular string 30 of FIGS. 1 & 2). When connected in the tubular string 30, a fluid flow passage 64 that extends longitudinally through the tubular string also extends longitudinally through the casing scraper 34.

"Casing friendly" hard-facing 66 can be provided on the end connectors 60, 62 to mitigate damage due to contact between the casing scraper 34 and the interior of the casing 16 while the casing scraper is in a retracted configuration. For example, if the casing scraper 34 is used in a drilling or milling operation, the casing scraper can be rotated extensively downhole, and the hard-facing 66 can prevent abrasive wear of the casing 16.

The casing scraper 34 also includes an actuator 68. The actuator 68 longitudinally displaces the scraper element housings 48 relative to the mandrel 54, in response to application of pressure differentials across the casing scraper 34.

In this example, the pressure differentials are produced between the flow passage 64 and an exterior of the casing scraper 34 (such as, the annulus 42 in the FIGS. 1 & 2 system 10). The pressure differentials can be produced by flowing a fluid 70 through the flow passage 64, and then out into the annulus 42 (for example, via nozzles in the cutting tool 32) in a forward-circulation direction.

Restrictions and friction in the flow passage 64 downstream of the casing scraper 34 (such as, a drilling motor, nozzles in the cutting tool 32, etc.) will result in a pressure differential being created from the flow passage 64 to the annulus 42 at the casing scraper 34. The applied pressure differential can be varied using a variety of different techniques or combinations of techniques. For example, an increase in flow rate or viscosity of the fluid 70 will generally result in an increase in the differential pressure.

In examples described more fully below, the pressure differential across the casing scraper 34 can be increased to a predetermined level, and then decreased, to thereby activate the casing scraper to an extended configuration, in which the scraper elements 44 are in contact with the interior surface of the surrounding tubular (casing 16 in the FIGS. 1 & 2 system 10). In addition, the pressure differential across the casing scraper 34 can be increased to a predetermined level, and then decreased, to thereby deactivate the casing scraper to a retracted configuration, in which the scraper elements 44 are withdrawn out of contact with the interior surface of the surrounding tubular. The casing scraper 34 can be activated and deactivated downhole any number of times, and in any order.

Referring additionally now to FIGS. 5A-E, a section of the casing scraper 34 is representatively illustrated at an increased scale, so that further details of the casing scraper are more easily seen. As in the description above, the casing scraper 34 is described as used in the system 10 and method of FIGS. 1 & 2, but the scope of this disclosure is not limited to use of the casing scraper in that particular (or a similar) system and method.

Figure 5A:
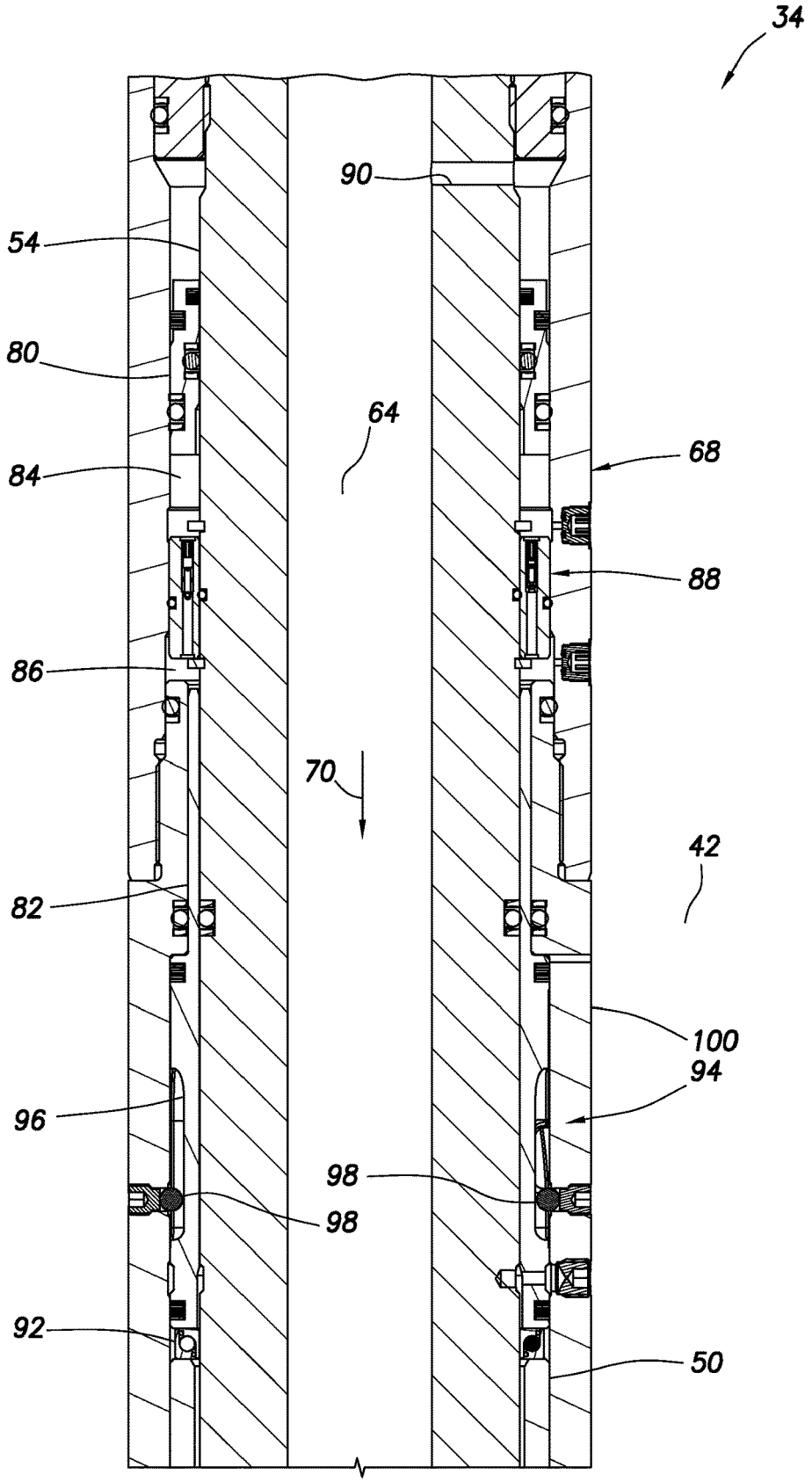
FIGS. 5A-E are representative cross-sectional views of successive longitudinal sections of the casing scraper.
Figure 5B:
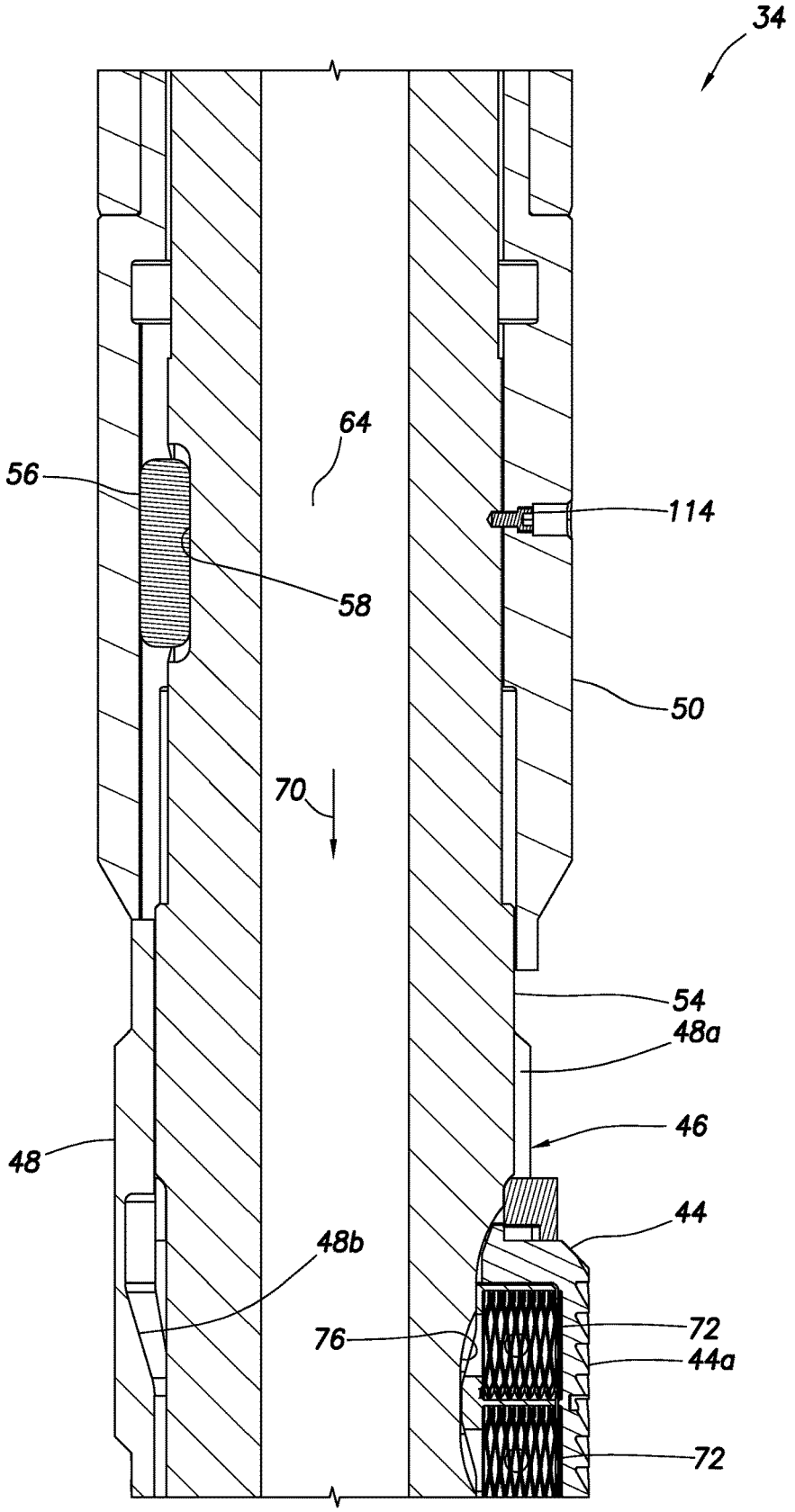
Figure 5C:
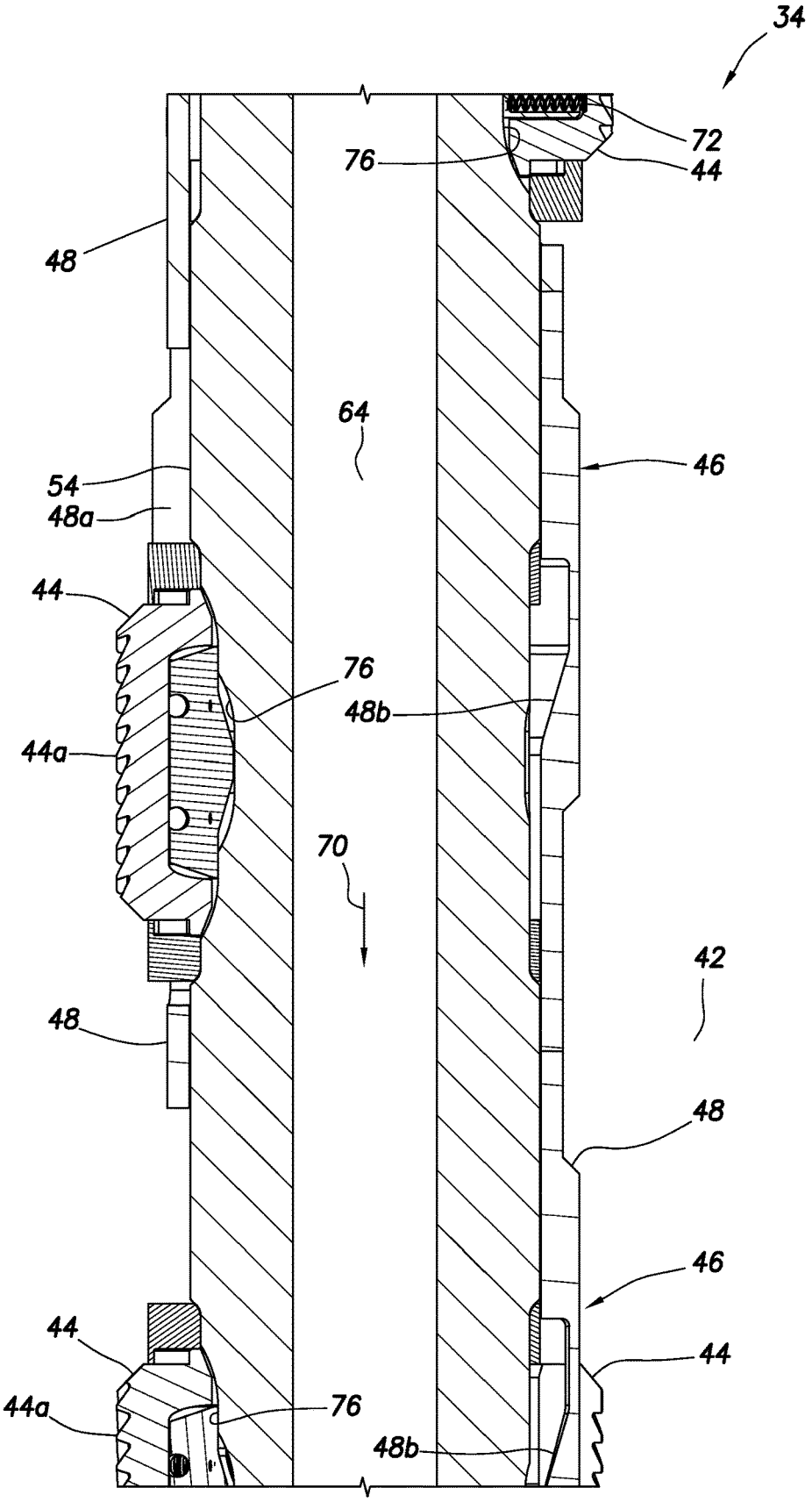

In FIGS. 5B & C, it may be seen that each of the scraper elements 44 is biased outward by springs 72. The scraper elements 44 are retained in recesses 76 formed on the mandrel 54. The scraper elements 44 can displace radially relative to the mandrel 54, but are prevented from displacing substantially longitudinally or rotationally relative to the mandrel.

Another spring 74 biases the housings 48 and outer housing sections 50, 52 upward (as viewed in FIGS. 5A-E) relative to the mandrel 54. An adjustable stop collar 78 can be used to vary a preload in the spring 74. The preload will determine a downward force applied to the housings 48 and outer housing sections 50, 52 needed to initiate downward displacement of the housings 48 relative to the mandrel 54.

Note that each of the scraper element housings 48 has inclined surfaces 48*b* formed therein. When the housings 48 displace longitudinally relative to the mandrel 54, the inclined surfaces 48*b* displace longitudinally relative to the scraper elements 44. This relative longitudinal displacement is used to alternately allow the scraper elements 44 to be extended outward by the springs 72 into contact with the interior of the surrounding tubular (such as, casing 16), or retract the scraper elements out of contact with the surrounding tubular.

The spring 74 continuously biases the housings 48 upward, toward a position in which the scraper elements 44 are retracted. The scraper elements 44 can be extended by applying a predetermined pressure differential across the casing scraper 34 (e.g., by increasing a flow rate of the fluid 70, increasing a viscosity of the fluid, increasing a resistance to flow through the passage 64 downstream of the casing scraper, etc.).

This pressure differential will be applied across the actuator 68. In this example, the actuator 68 includes pistons 80, 82 exposed to respective fluid chambers 84, 86 separated by a flow restrictor 88.

The piston 80 is on one side exposed to the flow passage 64 via a port 90. The piston 80 can be considered a "floating" piston, and so pressure in the chamber 84 will be essentially the same as pressure in the flow passage 64. The piston 80 isolates clean fluid in the chamber 84 from the fluid 70 in the flow passage 64.

The piston 82 is exposed on one side to pressure on the exterior of the casing scraper 34 (such as, in the annulus 42 in the system 10 of FIGS. 1 & 2). The other side of the piston 82 is exposed to the chamber 86, and so the piston 82 can be effective to transmit pressure from the exterior of the casing scraper 34 to the chamber 86.

Note that the biasing force exerted by the spring 74 is also transmitted to the chamber 86 via the piston 82, and so pressure in the chamber 86 must exceed a sum of the pressure transmitted from the exterior and pressure due to the spring 74 force, in order to displace the housings 48 and outer housing sections 50, 52 downward relative to the mandrel 54. A bearing 92 provides an interface between the outer housing section 50 and the piston 82, permitting transmission of longitudinally compressive force, and permitting relative rotation between the outer housing section 50 and the piston 82.

The flow restrictor 88 substantially restricts flow from the chamber 84 to the chamber 86. For a given differential pressure across the flow restrictor 88, a given fluid viscosity and a given temperature, a certain amount of time will be needed to flow a given volume of fluid from the chamber 84 to the chamber 86. This certain amount of time can provide a delay, so that the differential pressure must be maintained at least the certain amount of time, before the casing scraper 34 can be activated or deactivated.

The piston 82, in this example, is also part of an index mechanism 94 that controls positions of the housings 48 and outer housing sections 50, 52 relative to the mandrel 54. The index mechanism 94 includes a continuous cam slot 96 formed circumferentially about the piston 82. The slot 96 is slidingly engaged by followers 98 (in this example, balls) extending inwardly from an outer housing assembly 100. The outer housing assembly 100 is fixed relative to the mandrel 54 (relative rotation and longitudinal displacement is prevented).

The index mechanism 94 is of the type known to those skilled in the art as a "J-slot" mechanism or ratchet, in this example, since sections of the slot 96 can resemble the letter "J." However, other types of index or ratchet mechanisms may be used, in keeping with the principles of this disclosure.

The outer housing section 50 and piston 82 can be initially retained against longitudinally downward displacement by an optional shear screw 114 (see FIG. 5B). The shear screw 114 can be designed to require a predetermined pressure differential be applied from the interior to the exterior of the casing scraper 34 to shear the shear screw and allow downward displacement of the piston 82 longitudinally relative to the mandrel 54.

When a sufficient pressure differential is applied from the flow passage 64 to the annulus 42 for a given amount of time (after shearing of the shear screw 114, if provided), the piston 82 will displace downward (as viewed in FIGS. 5A-E), and the slot 96 will thus displace downward relative to the followers 98. When the pressure differential is reduced sufficiently, the spring 74 will displace the piston 82 upward, and the slot 96 will thus displace upward relative to the followers 98. As viewed in FIG. 5A, the piston 82 is fully upwardly displaced and contacts an internal shoulder in the outer housing assembly 100.

In the retracted configuration of FIGS. 5A-E, the piston 82, housings 48 and outer housing sections 50, 52 are fully upwardly displaced relative to the mandrel 54. In this position, the scraper element housings 48 maintain the scraper elements 44 inwardly displaced, so that they are not in contact with the interior surface of a surrounding tubular.

Figure 5D:
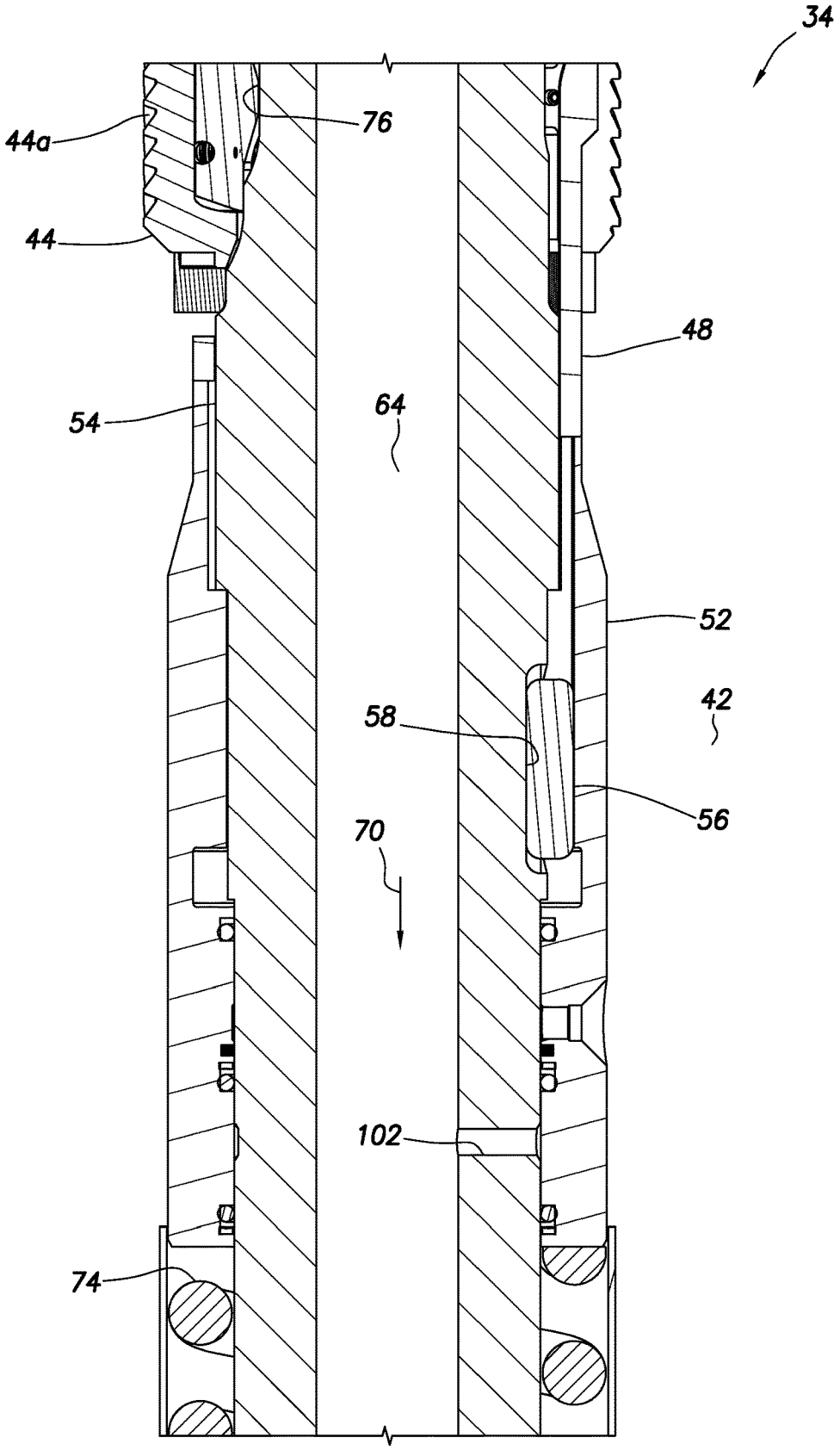
Figure 5E:
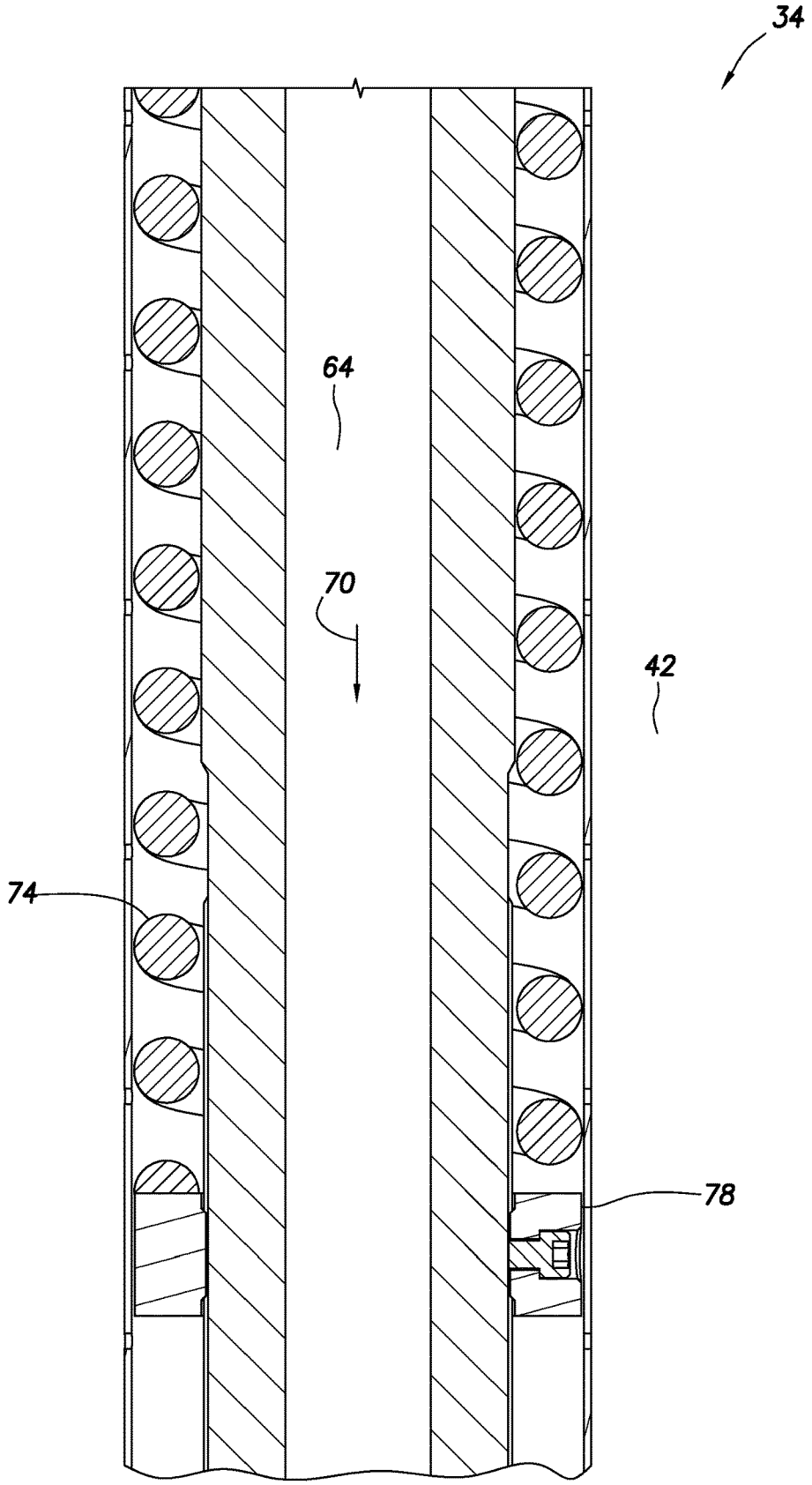

In FIG. 5D, it can be seen that, in this retracted configuration of the casing scraper 34, a bypass port 102 is closed. However, in the extended configuration of the casing scraper 34, the bypass port 102 is opened to thereby provide an indication (e.g., a reduction in pressure applied to the tubular string 30 at surface) to confirm that the casing scraper is in the extended configuration.

Figure 6:
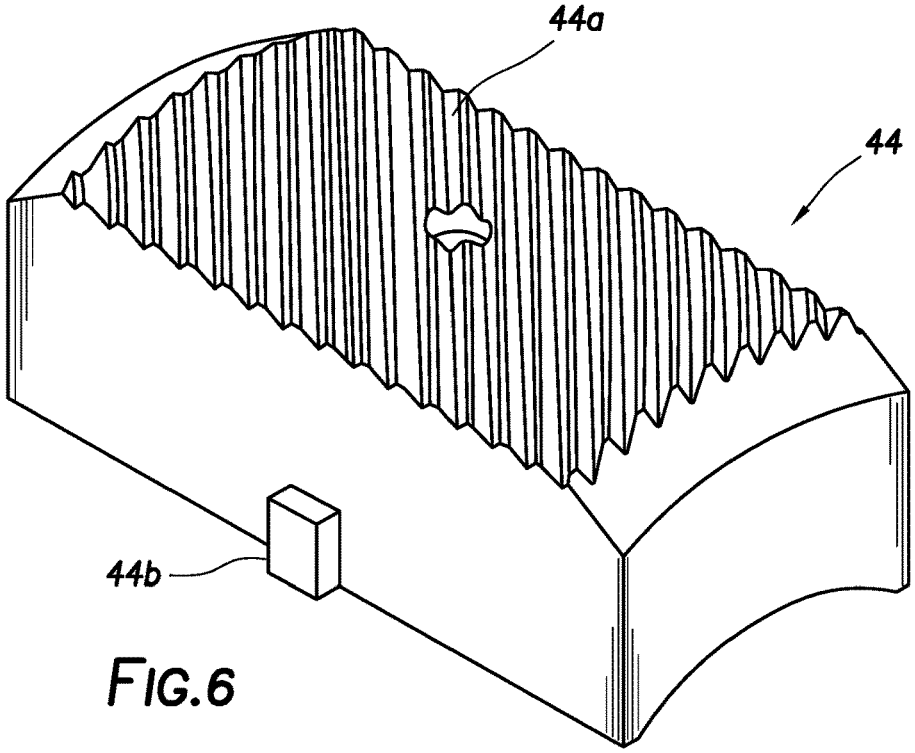
FIG. 6 is a representative perspective view of an example of a scraper element that may be used with the casing scraper.

Referring additionally now to FIG. 6, one example of the scraper element 44 is representatively illustrated. In this example, the cleaning surface 44*a* is formed directly on the scraper element 44 as ridges or teeth extending diagonally across the cleaning surface. In other examples, structures other than ridges or teeth (such as, buttons or cones, brushes or other flexible members, abrasives, etc.) may be used on the cleaning surface 44*a*.

Followers 44*b* are formed as protrusions extending outwardly from opposite lateral sides of the scraper element 44. The scraper element 44, including the followers 44*b*, is biased outwardly into contact with an interior surface of a scraper element housing 48 by the springs 72 (see FIG. 5B). The followers 44*b* are configured to slidingly engage the interior surface of the scraper element housing 48, so that the scraper element 44 is extended and retracted in response to relative displacement between the scraper element housing 48 and the scraper element 44.

Figure 7:
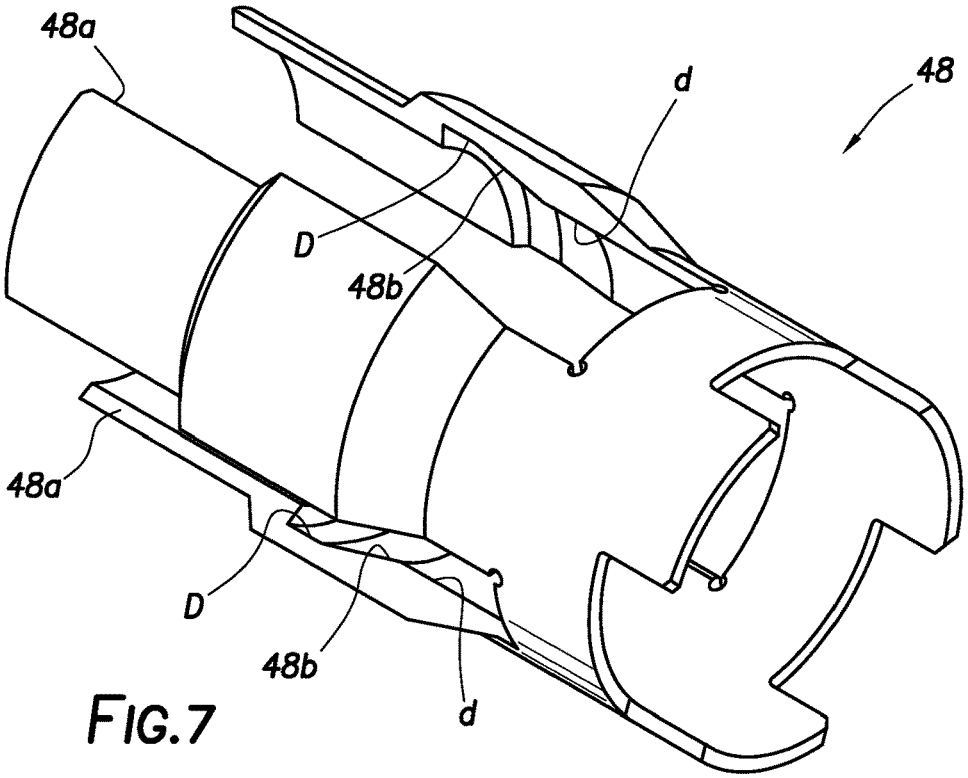
FIG. 7 is a representative perspective view of an example of a scraper element housing that may be used with the casing scraper.

As representatively illustrated in FIG. 7, the scraper element housing 48 has an interior surface that includes the inclined surface 48*b*. The inclined surface 48*b* extends radially and longitudinally between an upper relatively larger inner diameter D and a lower relatively smaller inner diameter d.

When the scraper element 44 is received in one of the housing slots 48*a*, and the followers 44*b* are in contact with the smaller diameter d, the scraper element is in its retracted position. When the followers 44*b* are in contact with the larger diameter D, the scraper element 44 is in its extended position.

Thus, the scraper element 44 can be extended by displacing the scraper element housing 48 downward relative to the scraper element, so that the springs 72 outwardly bias the followers 44*b* toward contact with the larger diameter D. The scraper element 44 can be retracted by displacing the scraper element housing 48 upward relative to the scraper element, so that the springs 72 outwardly bias the followers 44*b* into contact with the smaller diameter d.

Figure 8:
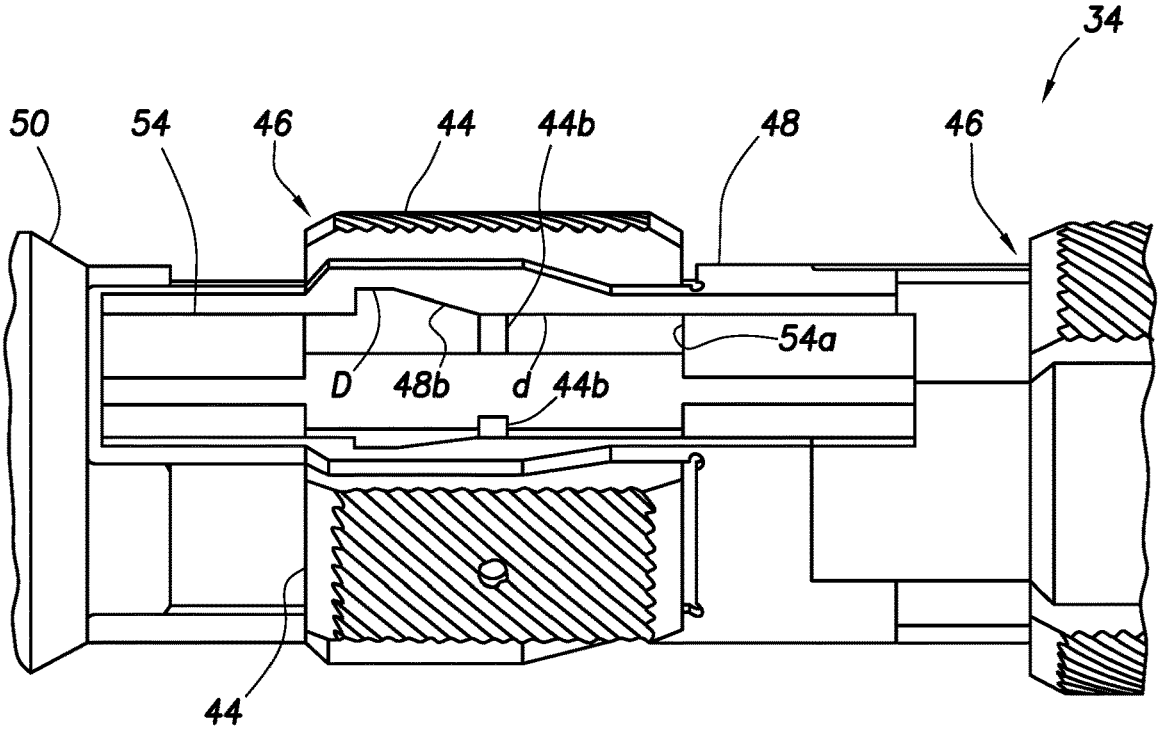
FIGS. 8 & 9 are representative side views of a scraper module of the casing scraper in respective retracted and extended configurations.
Figure 9:
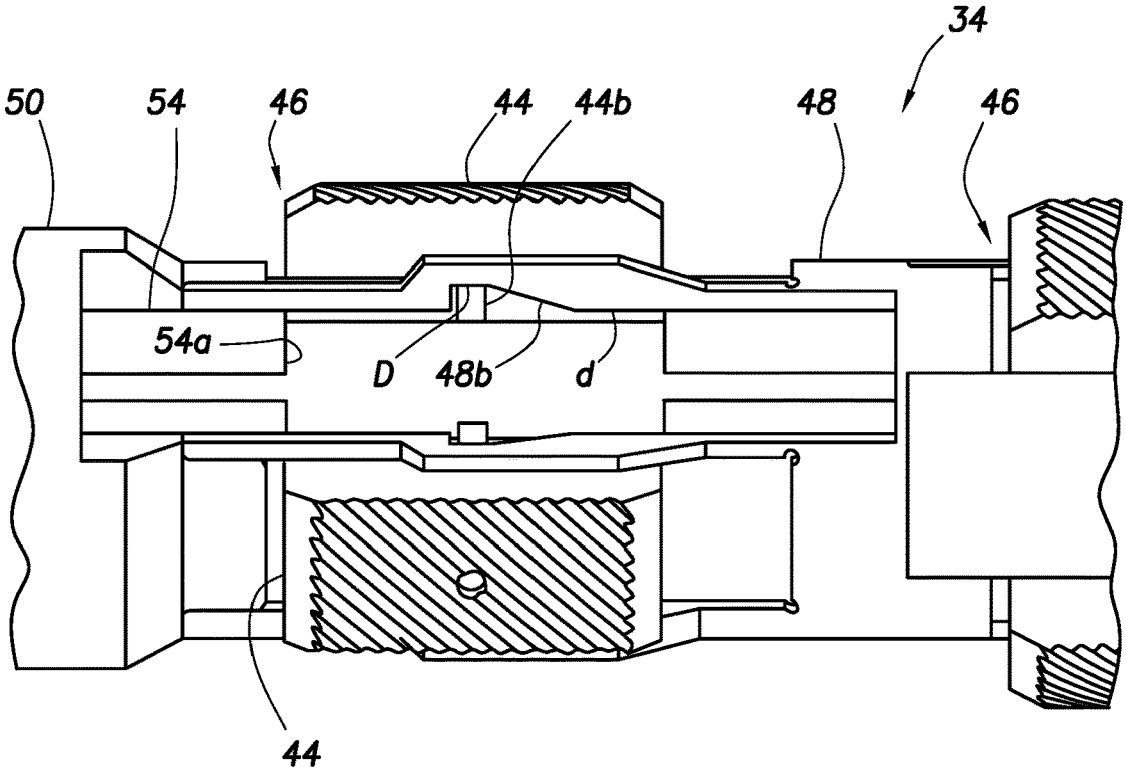

Referring additionally now to FIGS. 8 & 9, the retracted and extended configurations of the casing scraper 34 are representatively illustrated for a section of the casing scraper. In these views, a portion of a scraper element housing 48 is cut away, so that relative positions of the scraper elements 44 and the scraper element housing 48 and mandrel 54 can be more clearly seen.

In FIG. 8, note that the followers 44*b* are in contact with the smaller diameter d of the scraper element housing 48 interior surface. Thus, the scraper elements 44 are retracted out of contact with the interior surface of a surrounding tubular.

In FIG. 9, the scraper element housing 48 is displaced downwardly (to the right as viewed in FIGS. 8 & 9) relative to the mandrel 54 and scraper elements 44. Thus, the scraper elements 44 are allowed to extend outward into contact with the interior surface of the surrounding tubular. At their maximum extension, the followers 44*b* can contact the larger diameter D of the scraper element housing 48 interior surface.

In the FIGS. 8 & 9 example, the scraper elements 44 are slidingly received in respective radially oriented openings 54*a* formed in the mandrel 54. The scraper elements 44 are secured in the openings 54*a* against substantial longitudinal and rotational displacement relative to the mandrel 54, while being permitted to displace radially relative to the mandrel.

Figure 10:
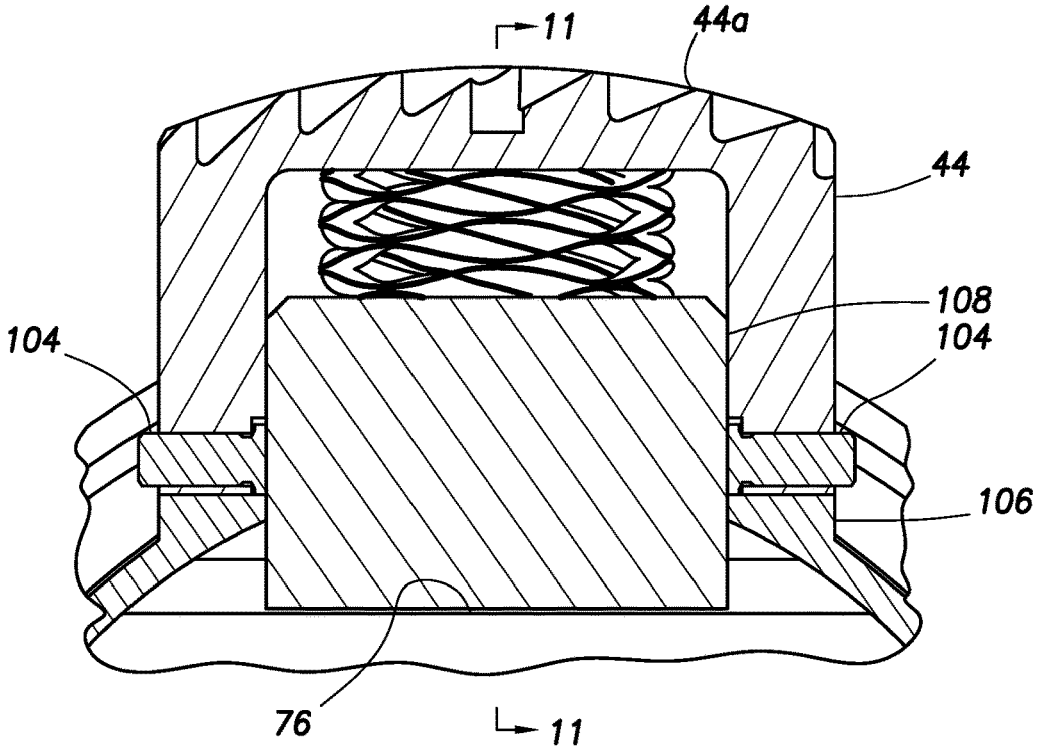
FIGS. 10 & 11 are representative cross-sectional views of another example of the scraper element, FIG. 11 being taken along line 11-11 of FIG. 10.
Figure 11:
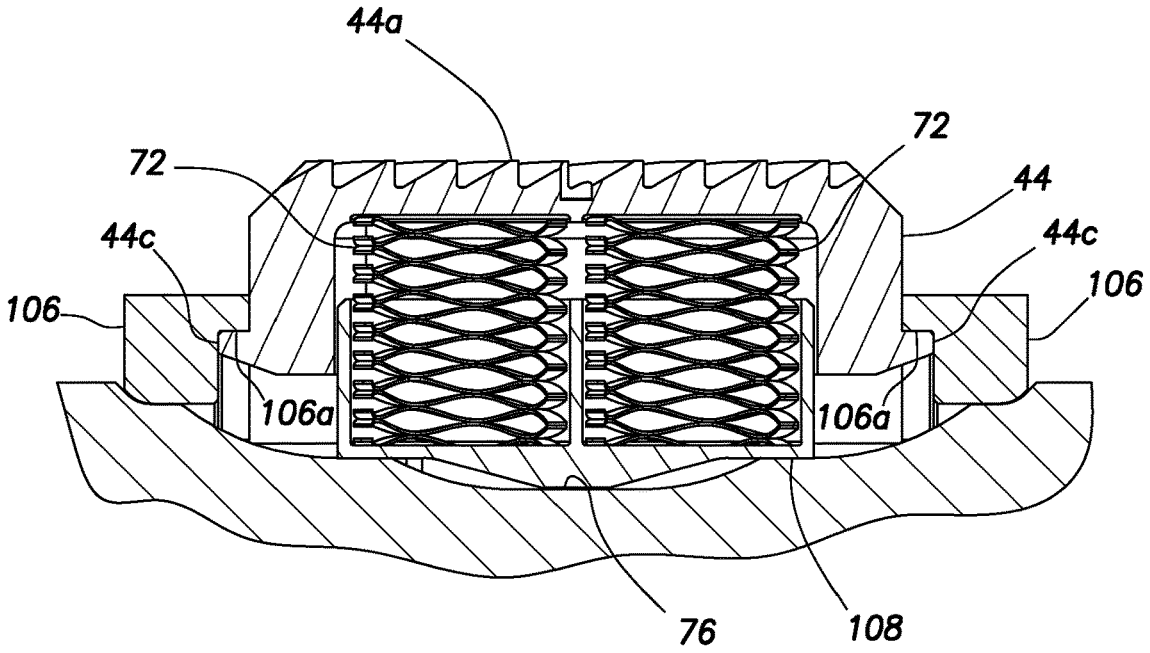

Referring additionally now to FIGS. 10 & 11, another example of the scraper element 44 is representatively illustrated. FIG. 11 is taken along line 11-11 of FIG. 10.

In the FIGS. 10 & 11 example, separate followers 104 are used in place of the integrally formed followers 44*b* on the scraper element 44. In addition, the scraper element 44 is slidingly disposed over an internal spring retainer 108, instead of being slidingly received in the openings 54*a* in the mandrel 54.

Outward displacement of the scraper element 44 is limited by engagement between tabs 44*c* and internal shoulders 106*a* formed in split support rings 106 that longitudinally straddle the scraper element 44. The support rings 106 and spring retainer 108 are received in the recess 76, which substantially fixes their longitudinal and rotational positions relative to the mandrel 54.

Figure 12:
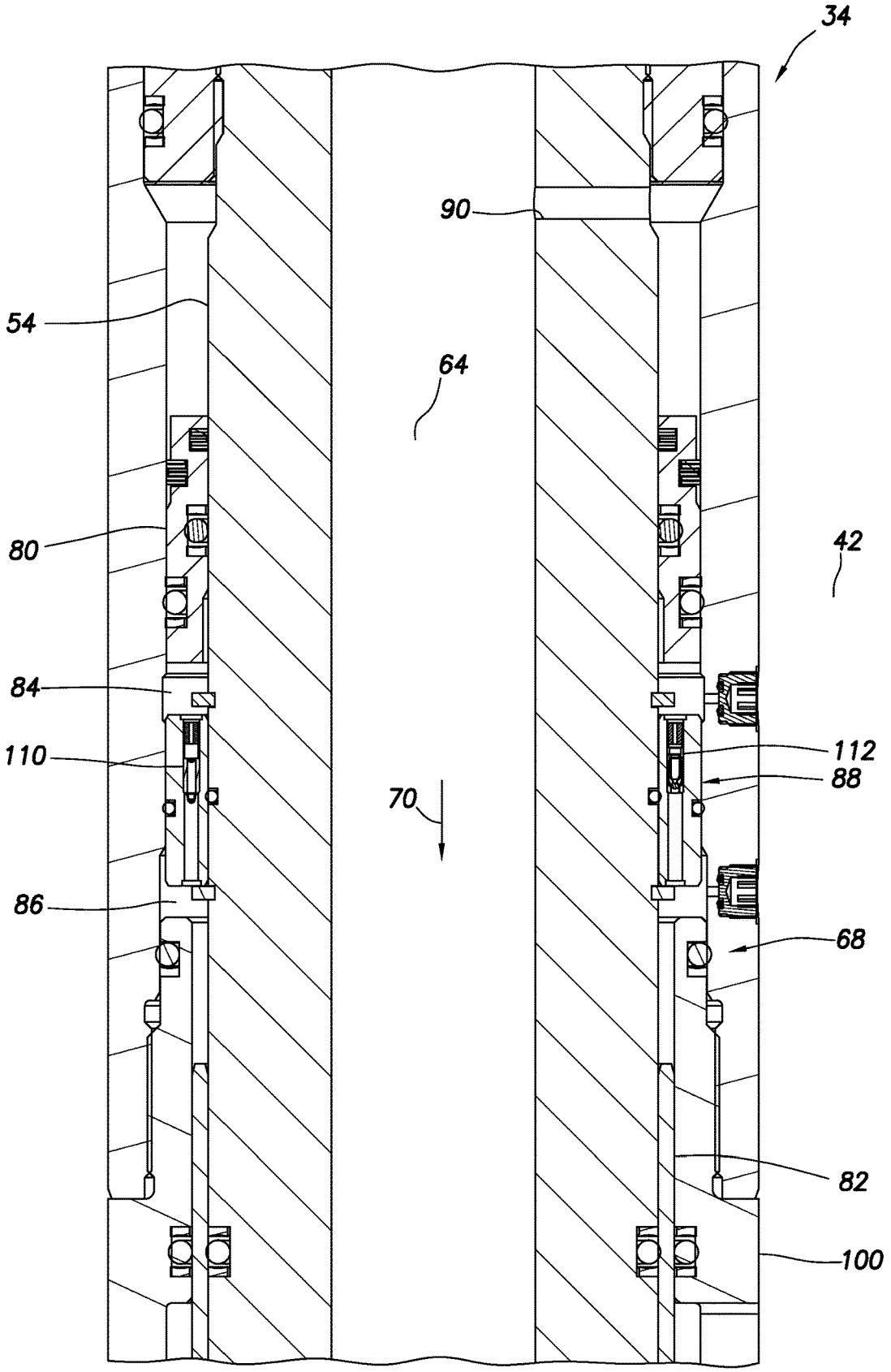
FIG. 12 is a representative cross-sectional view of a longitudinal section of the casing scraper.

Referring additionally now to FIG. 12, a cross-sectional view of a portion of the casing scraper 34 is representatively illustrated. In this view, further details of the flow restrictor 88 can be more clearly seen.

The flow restrictor 88 in this example includes a restrictor element 110 that substantially restricts flow between the chambers 84, 86. A suitable restrictor element can be a VISCO JET™ marketed by The Lee Company of Westbrook, Conn. USA. Other types of restrictors and orifices may be used in other examples.

The flow restrictor 88 also includes a check valve 112 that permits substantially unrestricted flow from the chamber 86 to the chamber 84, and prevents flow in a reverse direction through the check valve. A suitable check valve is marketed by The Lee Company, although other check valves may be used, and use of the check valve 112 is not required.

Flow from the chamber 84 to the chamber 86 is substantially restricted (e.g., requiring at least several minutes of a predetermined pressure differential to flow a given volume of fluid from the chamber 84 to the chamber 86), but flow from the chamber 86 to the chamber 84 is substantially unrestricted. Accordingly, the piston 82, housings 48 and outer housing sections 50, 52 (see FIGS. 5A-C) will displace slowly downward relative to the mandrel 54 when a sufficient pressure differential is applied, but the piston 82, housings 48 and outer housing sections 50, 52 will be displaced upward relative to the mandrel 54 relatively unhindered when the pressure differential is reduced.

Figure 13:
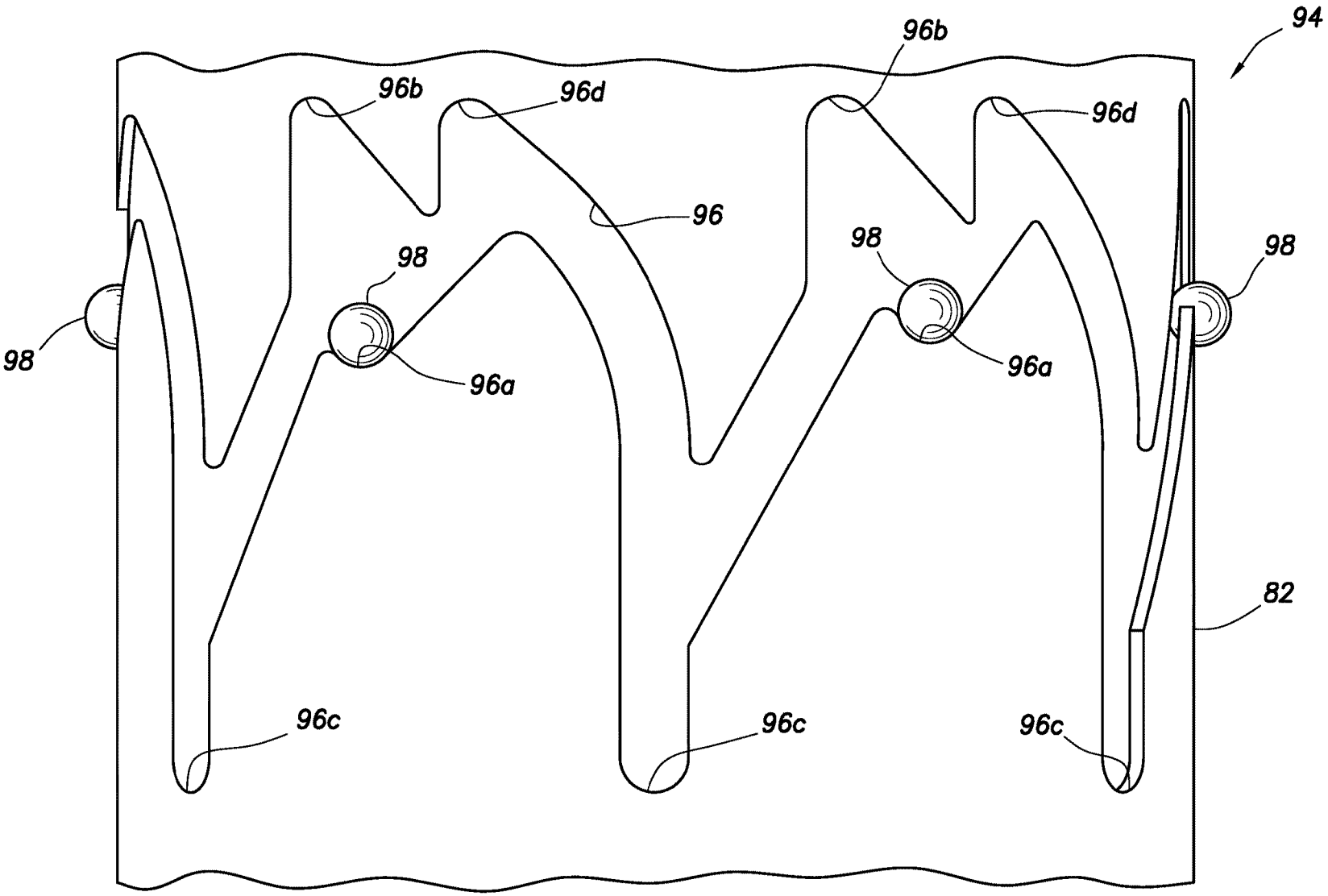
FIG. 13 is a representative elevational view of an example of a J-slot index mechanism of the casing scraper.
Figure 14A:
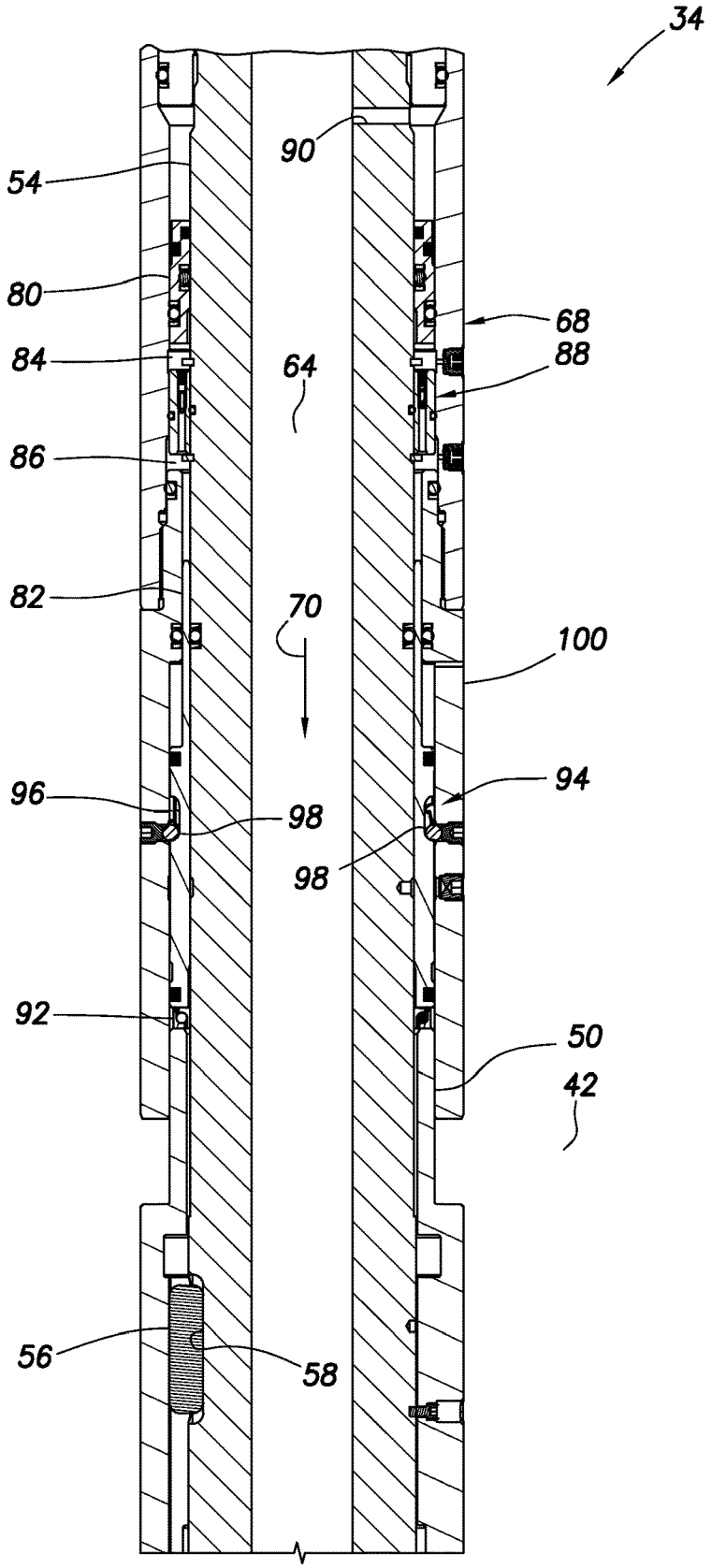
FIGS. 14A-D are representative cross-sectional views of the casing scraper in an extended configuration.
Figure 14B:
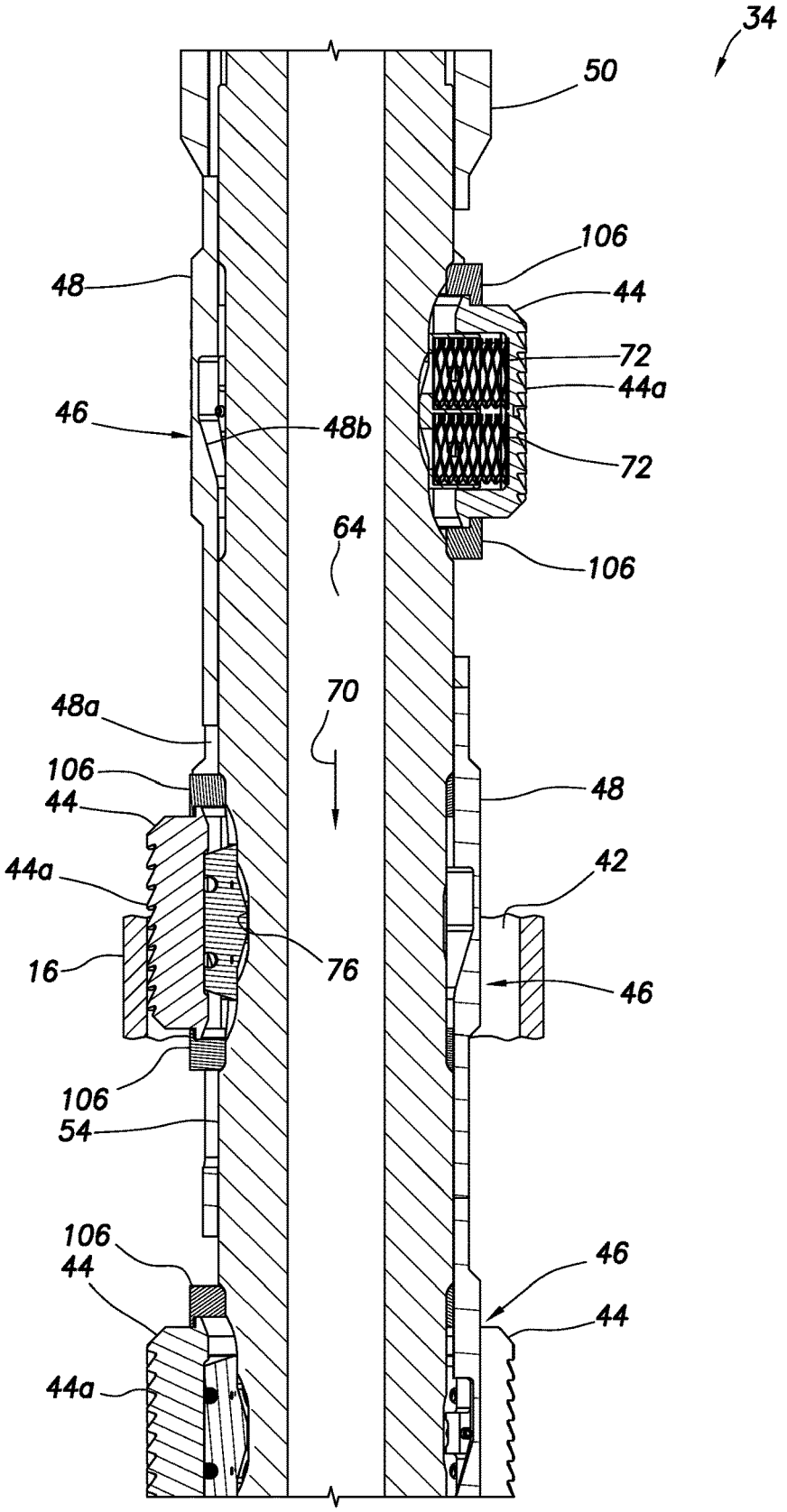
Figure 14C:
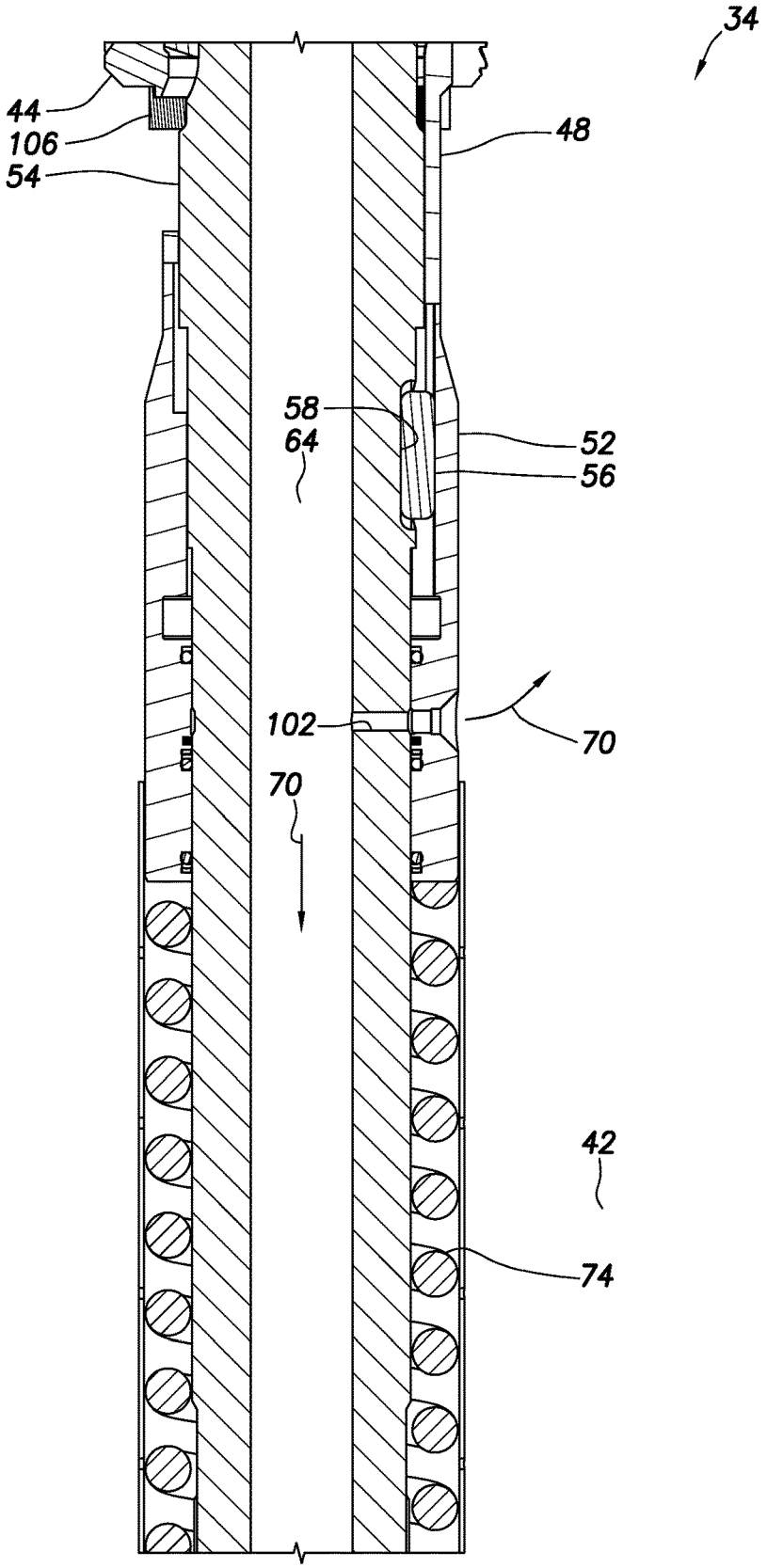
Figure 14D:
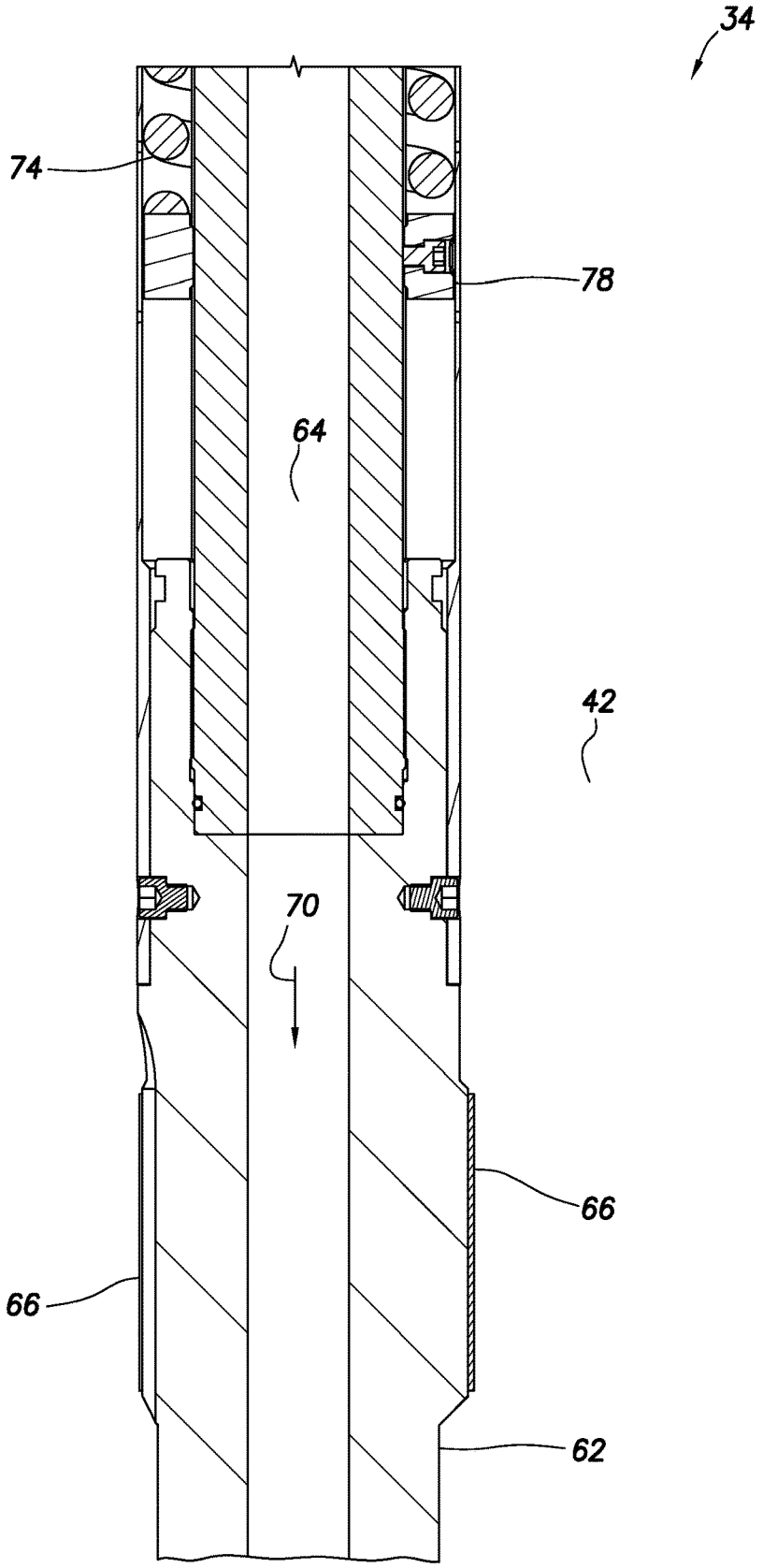

Referring additionally now to FIG. 13, components of the index mechanism 94 are representatively illustrated, apart from the remainder of the casing scraper 34 and actuator 68. In this view, the manner in which the slot 96 on the piston 82 displaces relative to the followers 98 can be more clearly seen.

As depicted in FIG. 13, the casing scraper 34 is in the extended configuration. The spring 74 biases the housings 48, outer housing sections 50, 52 and the piston 82 upward, but the followers 98 are received in recesses 96*a* of the slot 96. This prevents the housings 48, outer housing sections 50, 52 and the piston 82 from displacing upward to their retracted configuration.

When at least a predetermined pressure differential is applied for at least a predetermined period of time (due to the flow restrictor 88), the housings 48, outer housing sections 50, 52 and the piston 82 will displace downward against the biasing force exerted by the spring 74, until the followers 98 engage recesses 96*b* of the slot 96. At that point, further downward displacement is prevented, and the pressure differential can be released, or at least reduced, to allow the spring 74 to displace the housings 48, outer housing sections 50, 52 and the piston 82 upward.

Eventually, the followers 98 will engage recesses 96*c* of the slot 96, thereby preventing further upward displacement of the housings 48, outer housing sections 50, 52 and the piston 82. The casing scraper 34 will then be in the retracted configuration (e.g., as depicted in FIG. 8, with the scraper element housings 48 upwardly displaced relative to the mandrel 54).

When another predetermined pressure differential is applied for another predetermined period of time (due to the flow restrictor 88), the housings 48, outer housing sections 50, 52 and the piston 82 will displace downward against the biasing force exerted by the spring 74, until the followers 98 engage recesses 96*d* of the slot 96. At that point, further downward displacement is prevented, and the pressure differential can be released, or at least reduced, to allow the spring 74 to displace the housings 48, outer housing sections 50, 52 and the piston 82 upward.

The followers 98 will eventually engage the recesses 96*a*, thereby returning the casing scraper 34 to its extended configuration as depicted in FIG. 13. It will be appreciated that pressure differentials can be alternately applied and released any number of times to cycle the casing scraper 34 back and forth between its extended and retracted configurations as many times as is desired, since the slot 96 is circumferentially continuous about the piston 82.

Note that it is not necessary for the followers 98 to engage ends of the recesses 96*a-d* of the slot 96. For example, the piston 82 can engage an internal shoulder in the outer housing assembly 100 (as shown in FIG. 5A), or other structural limits can be used to determine the upper and lower stroke extents of the piston 82 relative to the mandrel 54, in keeping with the principles of this disclosure.

Referring additionally now to FIGS. 14A-D, the casing scraper 34 is representatively illustrated in its extended configuration. The followers 98 are received in the recesses 96*a* of the slot 96 (see FIG. 13), and the housings 48, outer housing sections 50, 52 and the piston 82 are in their downward position relative to the mandrel 54. The scraper elements 44 are permitted to displace radially outward (biased by the springs 72), due to the downward displacement of the scraper element housings 48 relative to the scraper elements 44 and associated followers 104.

The bypass port 102 is now open, due to the downward displacement of the housings 48 and outer housing sections 50, 52. With the bypass port 102 open, the fluid 70 can flow from the flow passage 64 to the annulus 42, while also flowing through the remainder of the tubular string 30. This should substantially reduce the restriction to flow of the fluid 70, and an operator at surface will accordingly notice a reduced pressure applied to the flow passage 64 at a given flow rate, thereby confirming that the casing scraper 34 is in its extended configuration.

Note that the spring 74 maintains an upwardly biasing force applied to the housings 48, outer housing sections 50, 52 and the piston 82, so the followers 98 are retained in engagement with the recesses 96*a*. The followers 98 will remain in engagement with the recesses 96*a* until a sufficient pressure differential is applied to overcome the biasing force of the spring 74 and displace the housings 48, outer housing sections 50, 52 and the piston 82 downward.

Referring additionally now to FIGS. 15-20, another example of the casing scraper 34 is representatively illustrated. FIGS. 15-20 depict various stages in operation of the casing scraper 34 between its retracted and extended configurations.

Only the actuator 68 section of the casing scraper 34 is depicted in FIGS. 15-20. The remainder of the casing scraper 34 (including the scraper element modules 46, outer housing section 52, spring 74, etc.) may be the same as, or similar to, those described above for the FIGS. 3A-14D example.

Note that, in the FIGS. 15-20 example, the piston 80 is initially retained against longitudinal displacement relative to the upper connector 60 and the mandrel 54 by a shear screw 114. The shear screw 114 can be designed to require a predetermined pressure differential be applied across the casing scraper 34 to shear the shear screw and allow displacement of the piston 80 longitudinally relative to the mandrel 54.

Figure 15:
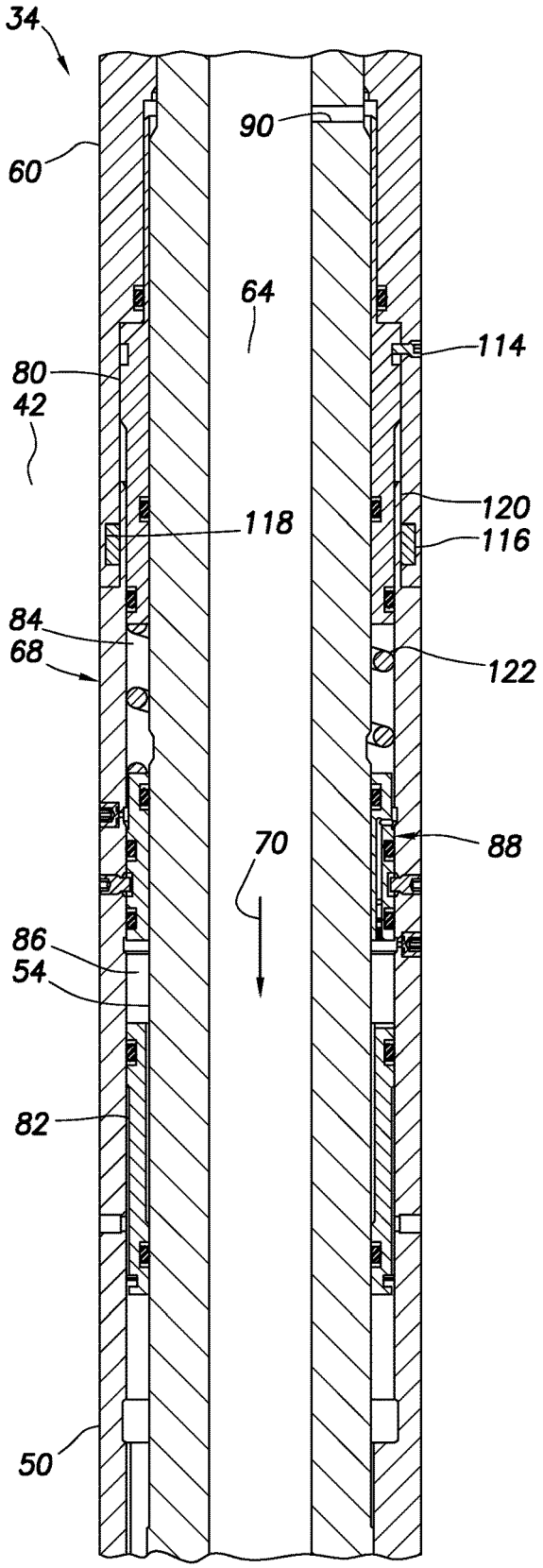
FIGS. 15-20 are representative cross-sectional views of a longitudinal section of another example of the casing scraper, the views showing successive steps in actuation of the casing scraper.

In FIG. 15, the casing scraper 34 is depicted in a run-in retracted configuration. The outer housing section 50 (and attached housings 48 and outer housing section 52, not visible in FIG. 15) are in their upwardly disposed position relative to the mandrel 54, and the scraper elements 44 (not visible in FIG. 15) are retracted out of contact with an interior surface of a surrounding tubular. The fluid 70 may be circulated through the flow passage 64 (for example, in a drilling operation), but the scraper elements 44 will not be extended until a predetermined pressure differential is applied across the casing scraper 34.

A resilient C-ring or snap ring 116 is received in an annular recess 118 formed in the upper connector 60. The snap ring 116 is radially inwardly biased, but is prevented from contracting radially by a tubular extension 120 extending upwardly from the outer housing section 50.

Figure 16:
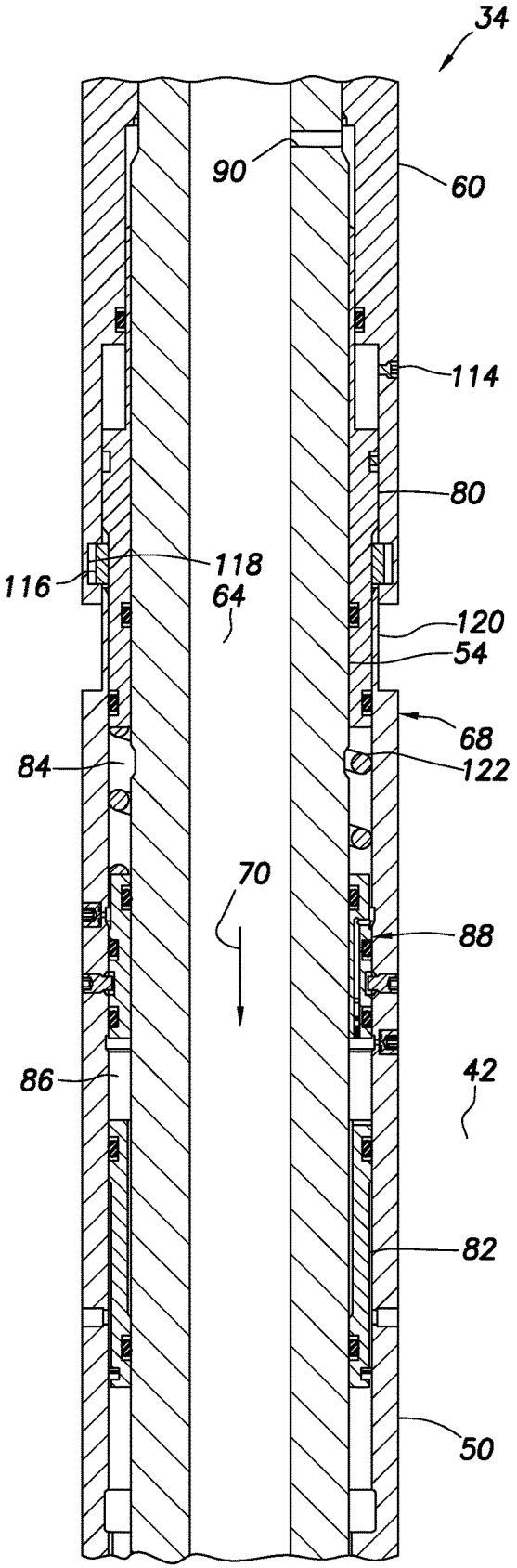

In FIG. 16, a sufficient pressure differential has been applied (for example, by increasing a flow rate of the fluid 70) to cause shearing of the shear screw 114. The piston 80 is thereby permitted to displace downwardly relative to the mandrel 54, due to the pressure differential. After the shear screw 114 has been sheared, the same or less pressure differential may be sufficient to downwardly displace the piston 80 relative to the mandrel 54.

In this example, the flow restrictor 88 is rigidly secured in the outer housing section 50. The chambers 84, 86 between the respective pistons 80, 82 and the flow restrictor 88 are filled with a substantially incompressible fluid and so, as the piston 80 displaces downward, so do the chamber 84, the flow restrictor 88, the chamber 86, the piston 82, the housings 48 and the outer housing sections 50, 52.

Thus, the casing scraper 34 is in the extended configuration as depicted in FIG. 16. The downward displacement of the housings 48 relative to the mandrel 54 extends the scraper elements 44 radially outward, as described above. The bypass port 102 (see FIG. 14C) is open in the extended configuration.

When the outer housing section 50 displaces downward, the extension 120 no longer outwardly supports the snap ring 116. The snap ring 116 contracts radially inward into contact with the piston 80. In this position, the snap ring 116 prevents upward displacement of the outer housing section 50 (and the attached housings 48 and outer housing section 52).

Note that a spring 122 in the chamber 84 biases the piston 80 upwardly relative to the flow restrictor 88 (and the attached outer housing sections 50, 52 and housings 48). The piston 80 can displace upward relative to the mandrel 54 due to the biasing force exerted by the spring 122, after the pressure differential is released (or at least reduced). This upward displacement of the piston 80 requires a given amount of time to transfer fluid from the chamber 86 to the chamber 84 via the flow restrictor 88.

Figure 17:
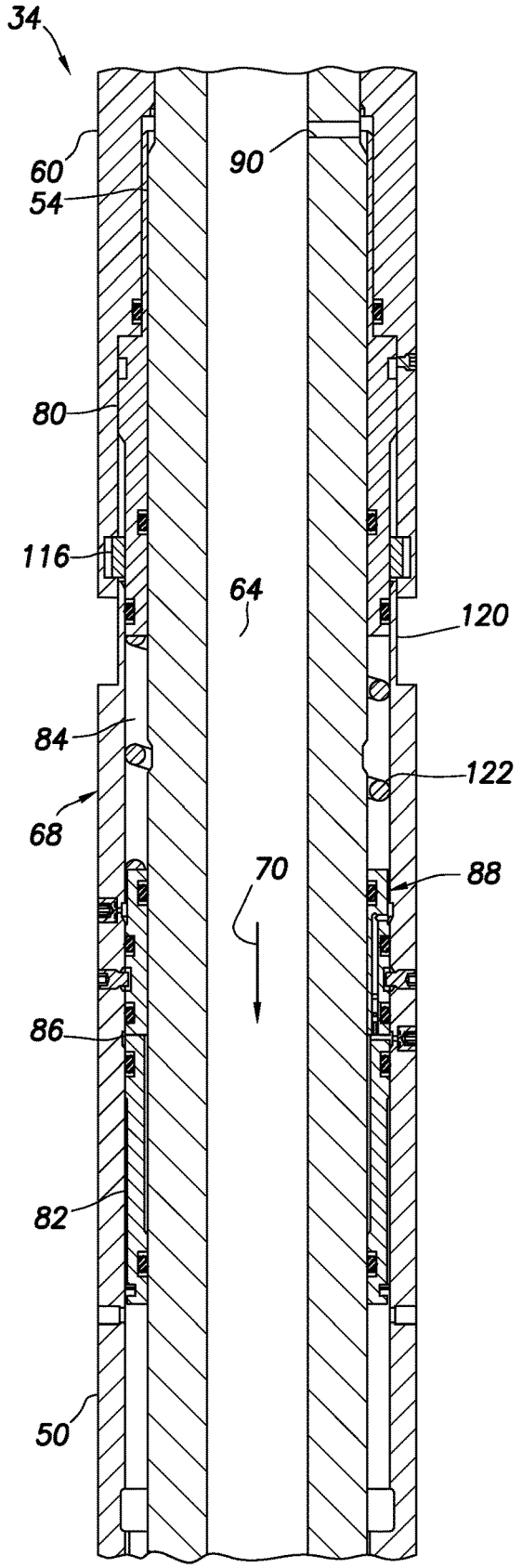

In FIG. 17, the casing scraper 34 is depicted after the pressure differential has been reduced and the piston 80 has displaced upward relative to the mandrel 54 due to the biasing force exerted by the spring 122. The piston 82 is also displaced upward, due to the transfer of fluid from the chamber 86 to the chamber 84. The snap ring 116 continues to prevent upward displacement of the outer housing section 50 relative to the mandrel 54.

Figure 18:
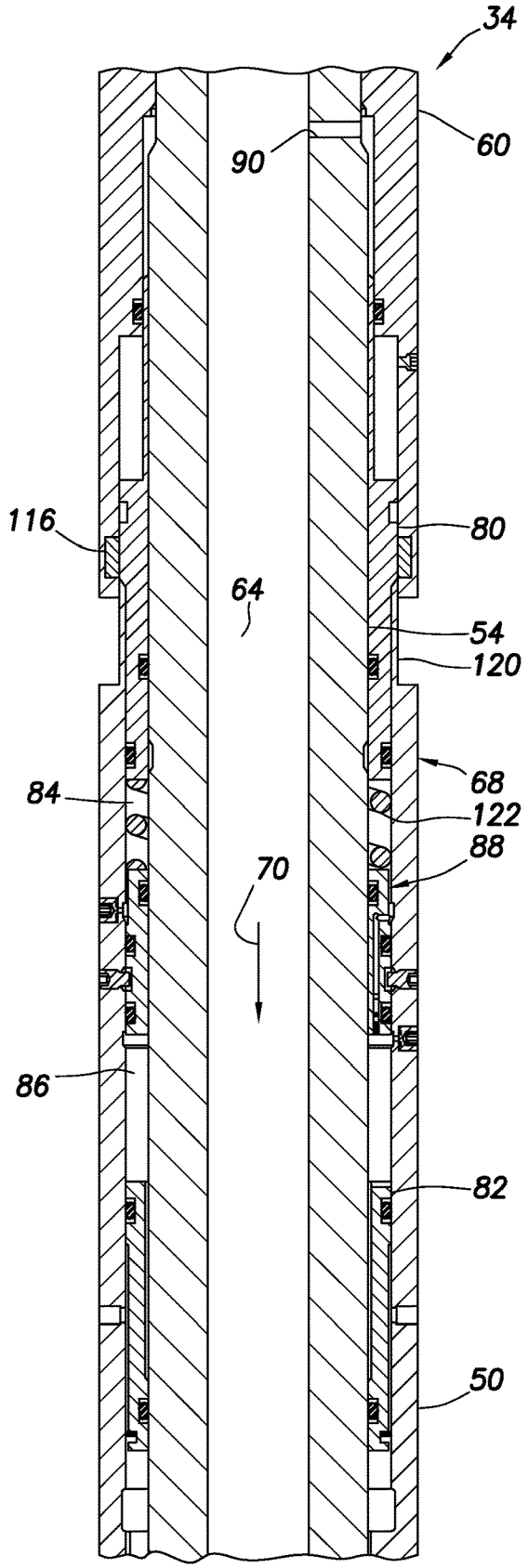

In FIG. 18, another predetermined pressure differential has been applied across the casing scraper 34 (the pressure differential being great enough to overcome the biasing force exerted by the spring 122). The pressure differential has caused the piston 80 to displace downward relative to the mandrel 54.

The pressure differential must be maintained for a sufficient period of time to allow a sufficient volume of fluid to transfer from the chamber 84 to the chamber 86 via the flow restrictor 88. Note that the piston 82 displaces downward, due to this transfer of fluid to the chamber 86.

Note, also, that the downward displacement of the piston 80 has caused the snap ring 116 to enlarge radially, due to an enlarged diameter on the piston 80 being received in the snap ring 116. The casing scraper 34 remains in its extended configuration.

Figure 19:
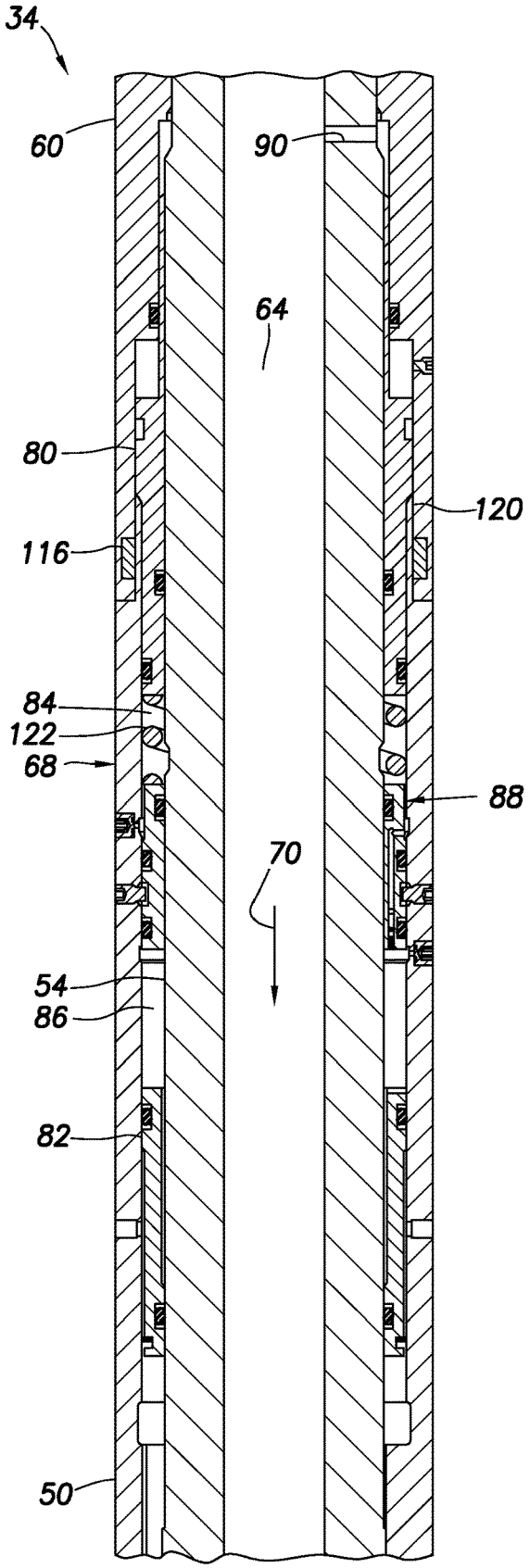

In FIG. 19, the pressure differential has been released (or at least reduced). The spring 74 has displaced the housings 48, outer housing sections 50, 52, pistons 80, 82, chambers 84, 86 and flow restrictor 88 upward relative to the mandrel 54. The radially enlarged snap ring 116 does not prevent this upward displacement of the outer housing section 50. The casing scraper 34 is now in its retracted configuration.

Figure 20:
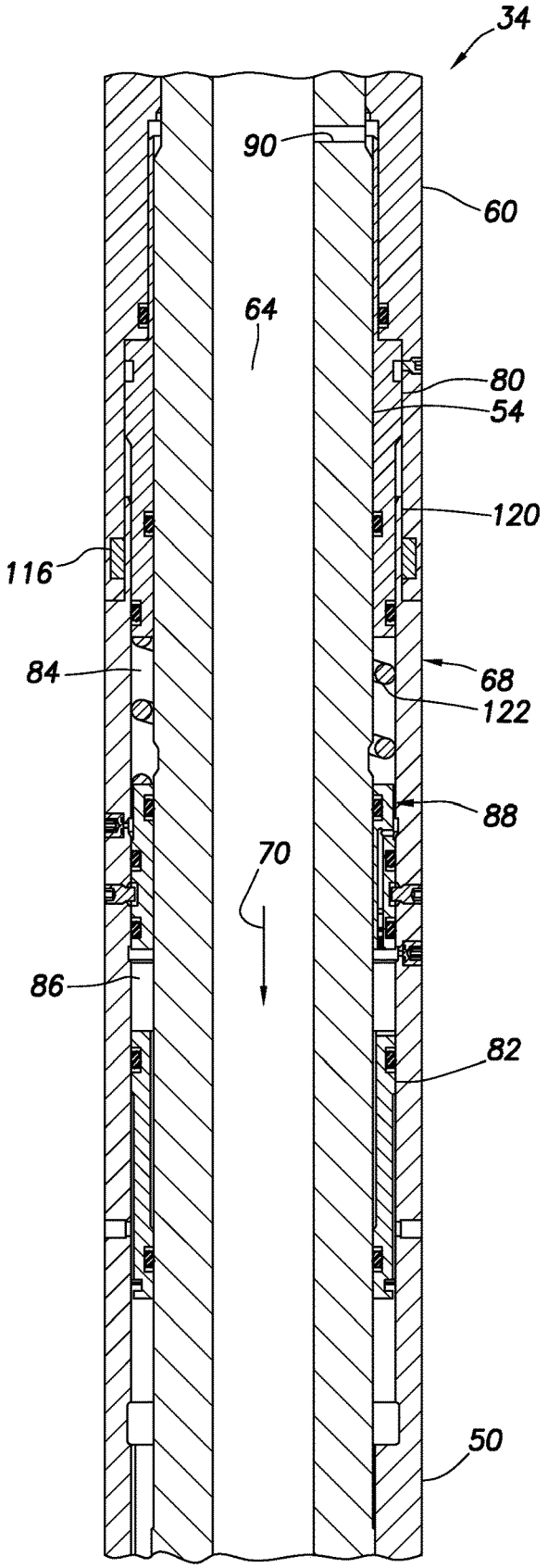

In FIG. 20, the spring 122 has displaced the piston 80 to its fully upward position relative to the mandrel 54. The casing scraper 34 is now returned to its FIG. 15 configuration, and is ready for another activation to the extended configuration as described above.

One difference between the FIGS. 15 & 20 configurations is that the shear screw 114 is sheared in the FIG. 20 configuration. This means that there is no need to apply a certain pressure differential to shear the shear screw 114 and initiate downward displacement of the piston 80 to activate the casing scraper 34. A sufficient pressure differential does need to be applied to overcome the biasing force exerted by the spring 74, but this pressure differential can be less than the pressure differential needed to shear the shear screw 114. In some examples, the pressure differential needed to overcome the biasing force exerted by the spring 74 could be equal to, or greater than, the pressure differential needed to shear the shear screw 114.

Figure 21:
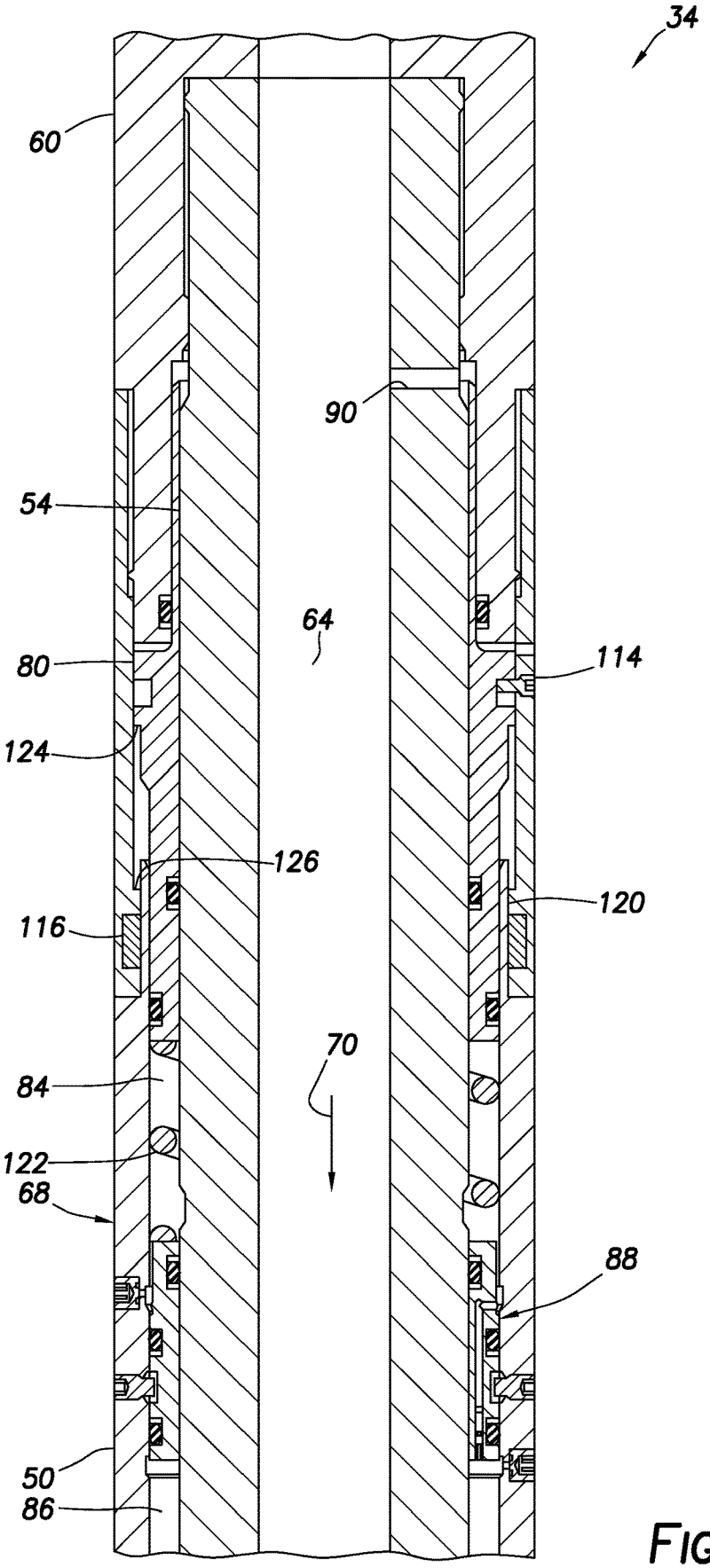
FIGS. 21 & 22 are representative cross-sectional views of a longitudinal section of yet another example of the casing scraper, the views showing successive steps in actuation of the casing scraper.
Figure 22:
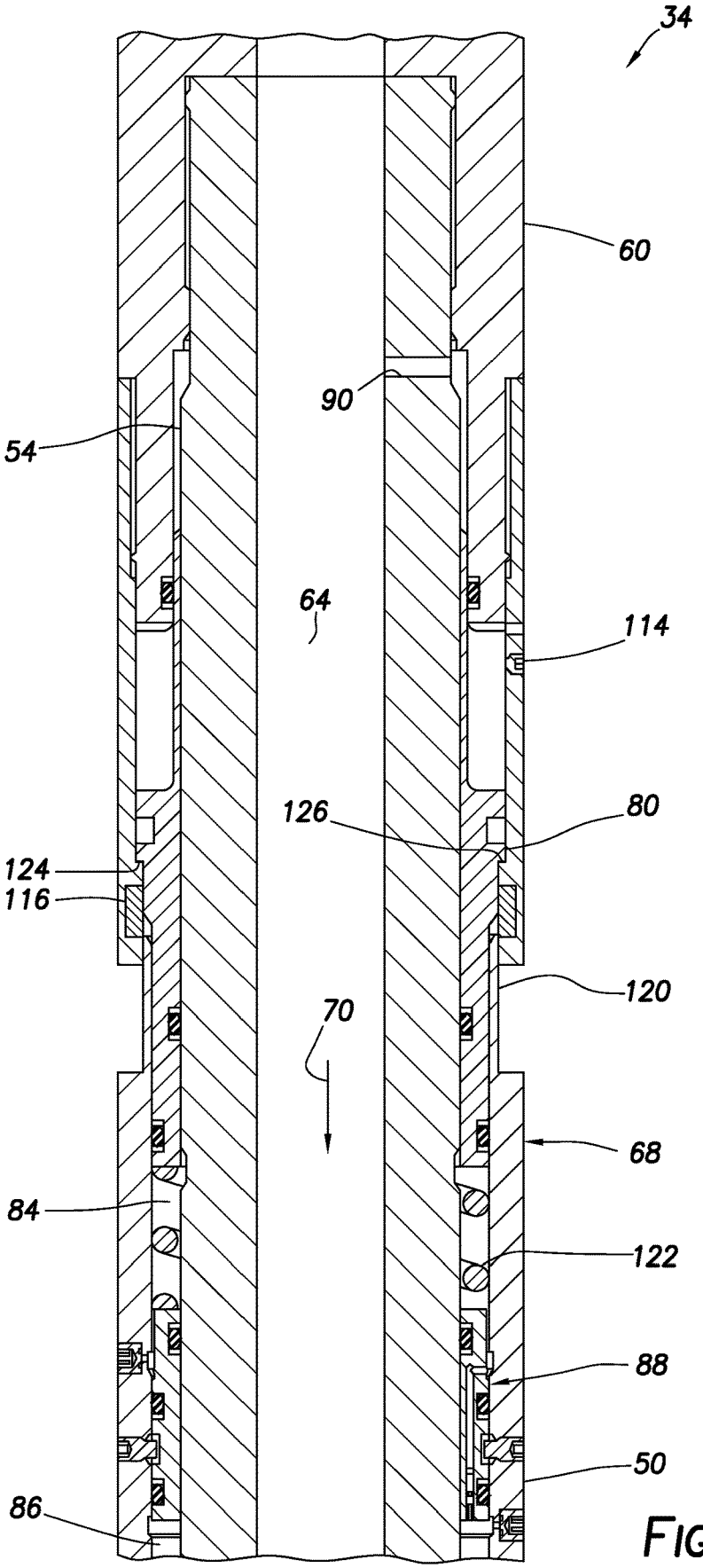

Referring additionally now to FIGS. 21 & 22 another example of the casing scraper actuator 68 is representatively illustrated. In this example, the piston 80 is configured somewhat differently from the FIGS. 15-20 example to provide for a more positive unlocking technique.

In FIG. 21, the actuator 68 is depicted in a run-in retracted configuration. Note that the shear screw 114 prevents longitudinal displacement of the piston 80 relative to the mandrel 54.

In FIG. 22, the actuator 68 is depicted after the casing scraper 34 has been activated to its extended configuration by applying and then releasing a pressure differential, and then another pressure differential has been applied to initiate deactivation of the casing scraper 34. Thus, the FIG. 22 position of the piston 80 is analogous to the FIG. 18 position for the FIGS. 15-20 example.

However, note that the piston 80 in the FIGS. 21 & 22 example includes an external shoulder 124 that engages an internal shoulder 126 when the piston is displaced downward to unlock the actuator 68 (to permit upward displacement of the outer housing sections 50, 52 and housings 48 to the retracted configuration). This engagement ensures that the piston 80 is appropriately positioned relative to the snap ring 116, so that the snap ring is radially expanded to permit upward displacement of the outer housing section 50.

Referring additionally now to FIGS. 23-28, another example of the casing scraper 34 is representatively illustrated. This example is similar in many respects to the FIGS. 15-22 example. However, in the FIGS. 23-28 example, the scraper elements 44 are extended in response to upward displacement of the housings 48 and outer housing sections 50, 52 relative to the mandrel 54, and the scraper elements 44 are retracted in response to downward displacement of the housings 48 and outer housing sections 50, 52 relative to the mandrel 54.

Figure 23:
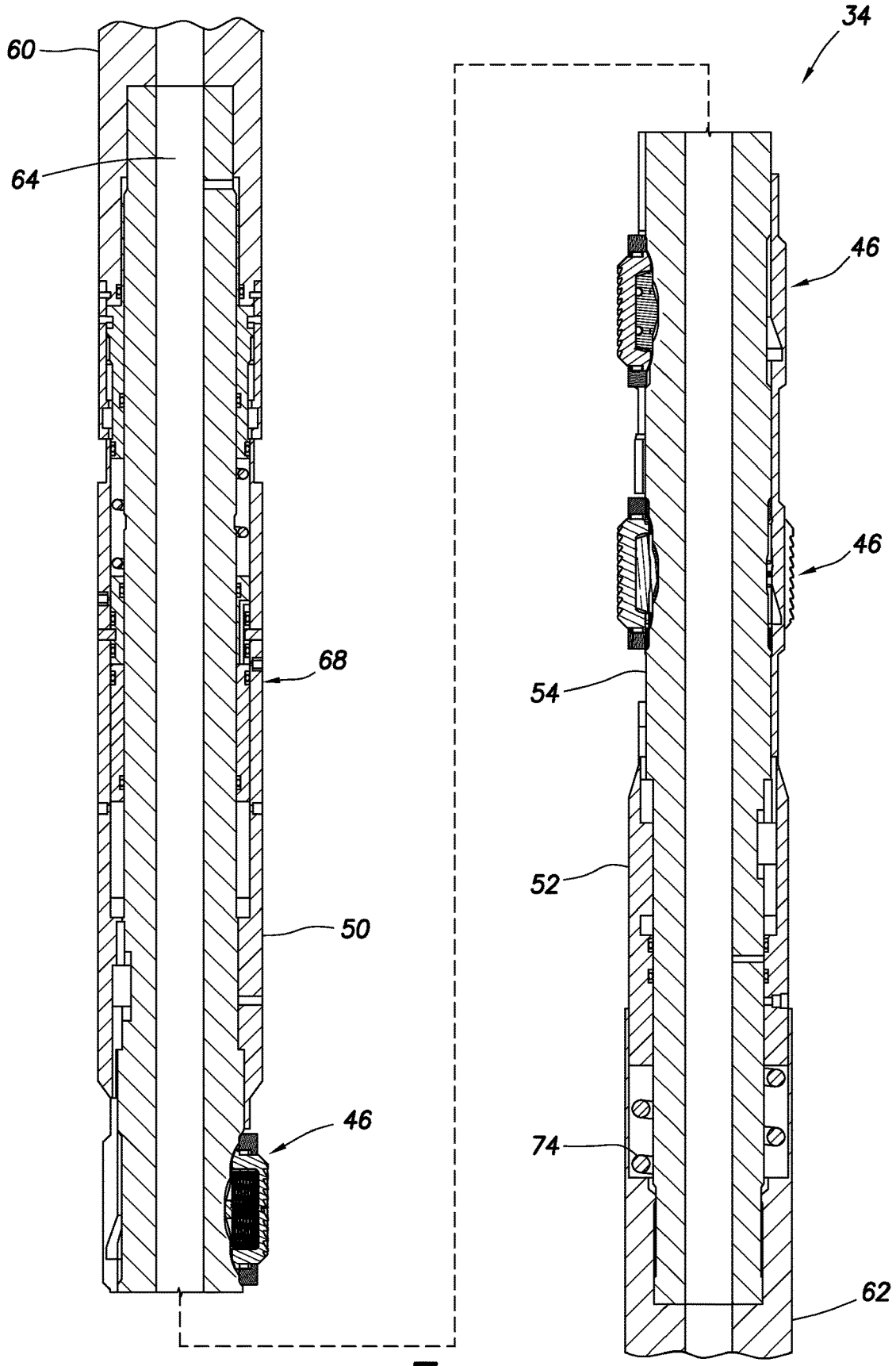
FIG. 23 is a representative cross-sectional view of a further example of the casing scraper.

As depicted in FIG. 23, the casing scraper 34 is in a run-in retracted configuration, with the housings 48 being in their downwardly disposed positions relative to the mandrel 54. The spring 74 biases the housings 48 and outer housing sections 50, 52 upward relative to the mandrel 54.

Figure 24:
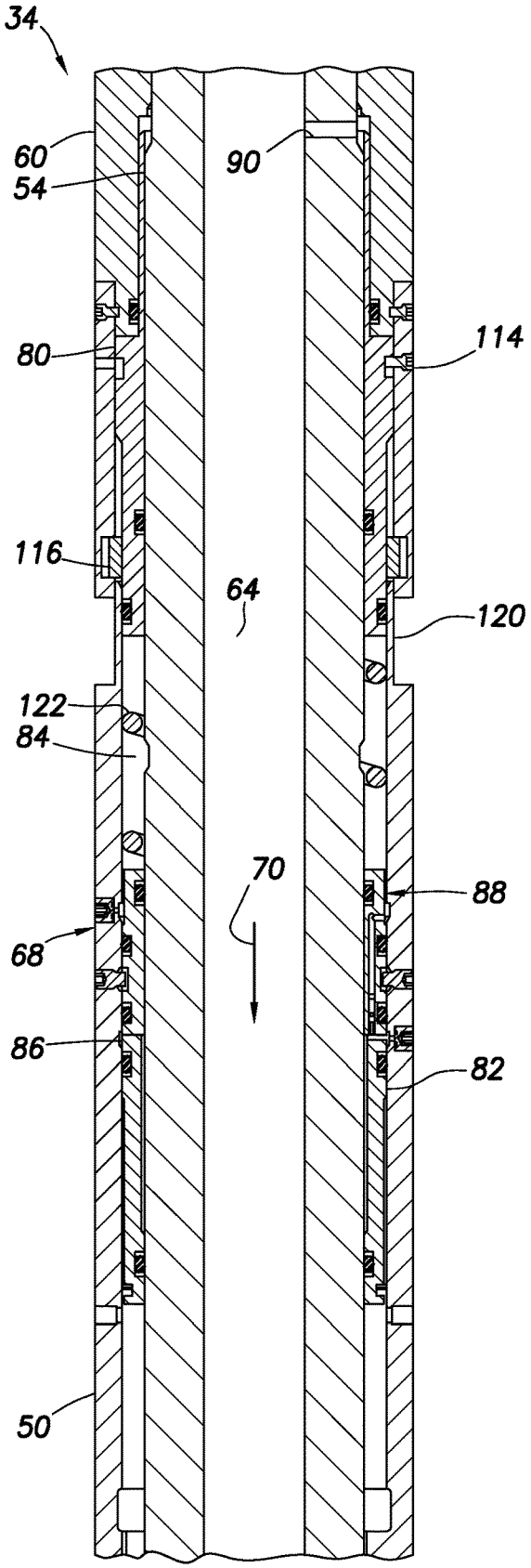
FIGS. 24-28 are representative cross-sectional views of longitudinal sections of the FIG. 23 casing scraper example, the views showing successive steps in actuation of the casing scraper.

In FIG. 24, the actuator 68 is representatively illustrated at a larger scale. The actuator 68 as depicted in FIG. 24 is in the run-in retracted configuration.

Note that the snap ring 116 is radially contracted, so that it prevents upward displacement of the outer housing section 50 and its extension 120. Thus, the actuator 68 is locked in the retracted configuration.

Figure 25:
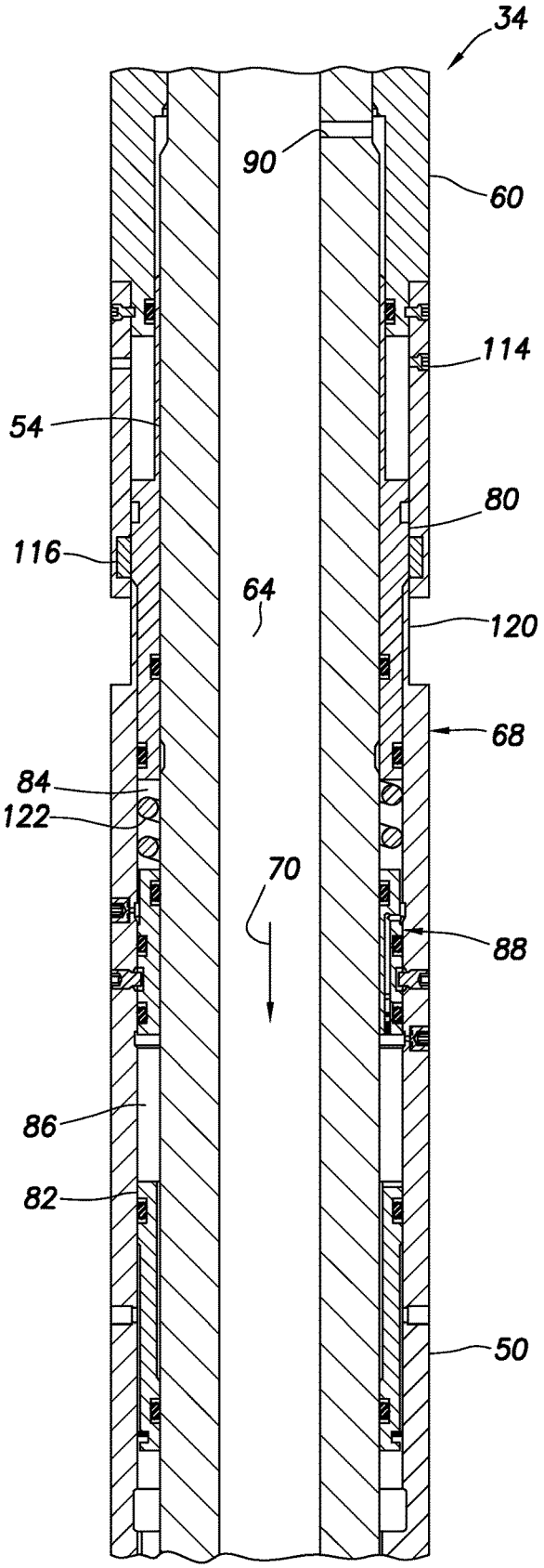

In FIG. 25, a sufficient pressure differential has been applied across the casing scraper 34 to overcome the biasing force exerted by the spring 74 and thereby displace the piston 80 downward. The shear screw 114 is sheared when a sufficient pressure differential is applied. In addition, a sufficient pressure differential needs to be applied for at least a certain period of time to transfer fluid from the chamber 84 to the chamber 86 via the flow restrictor 88, in order to allow the piston 80 to displace fully downward relative to the mandrel 54.

With the piston 80 in the FIG. 25 unlocked position, the snap ring 116 is radially expanded by the piston 80. The outer housing section 50 and its extension 120 can subsequently be displaced upwardly by the spring 74 when the pressure differential is reduced.

Figure 26:
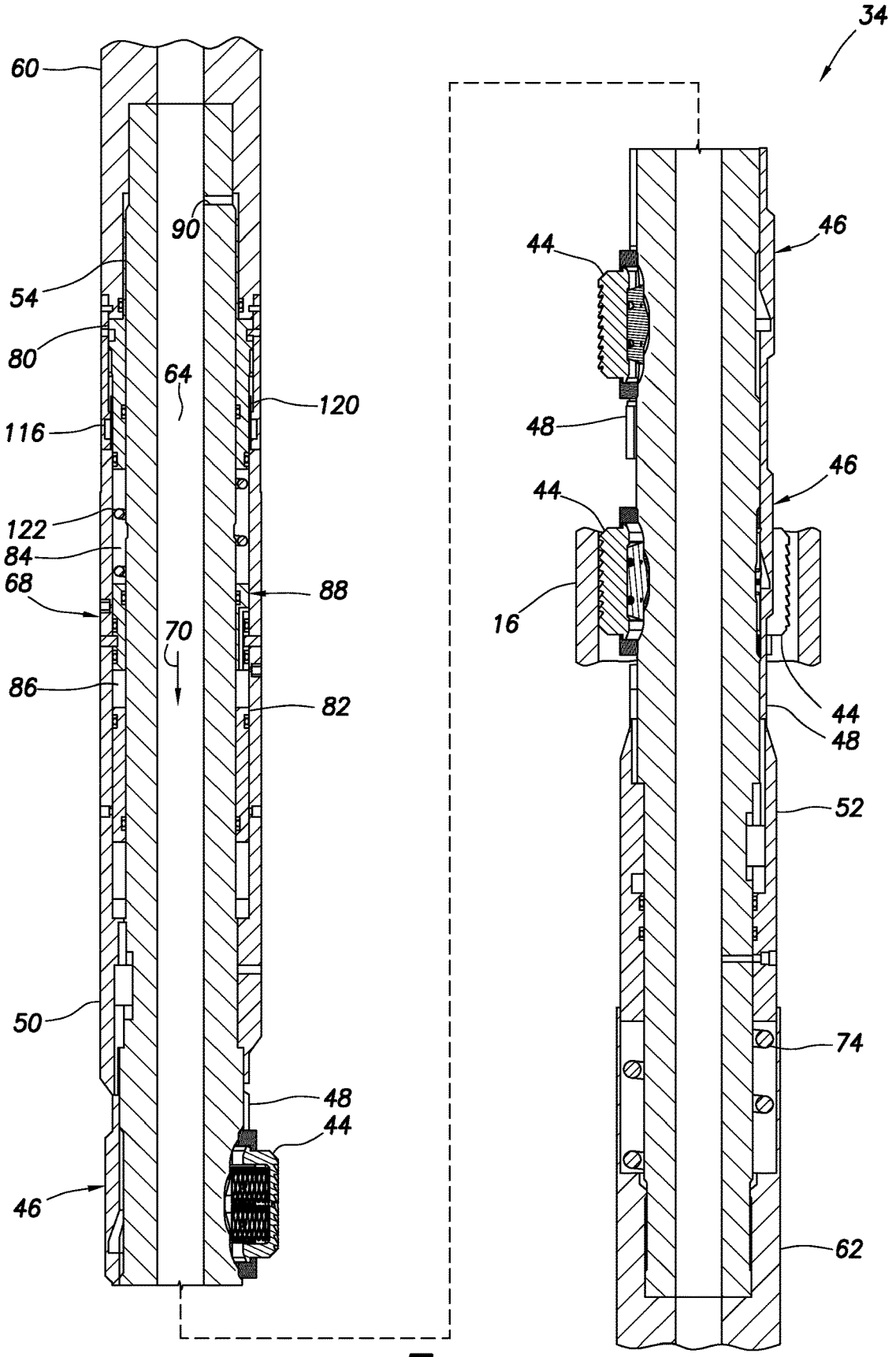

In FIG. 26, the pressure differential has been released (or at least reduced), and the housings 48 and outer housing sections 50, 52 have been displaced upward relative to the mandrel 54 by the spring 74. The casing scraper 34 is now in the extended configuration, with the scraper elements 44 extended outward so that they can contact and clean an interior surface of a surrounding tubular (such as the casing 16 in the FIGS. 1 & 2 system 10).

Figure 27:
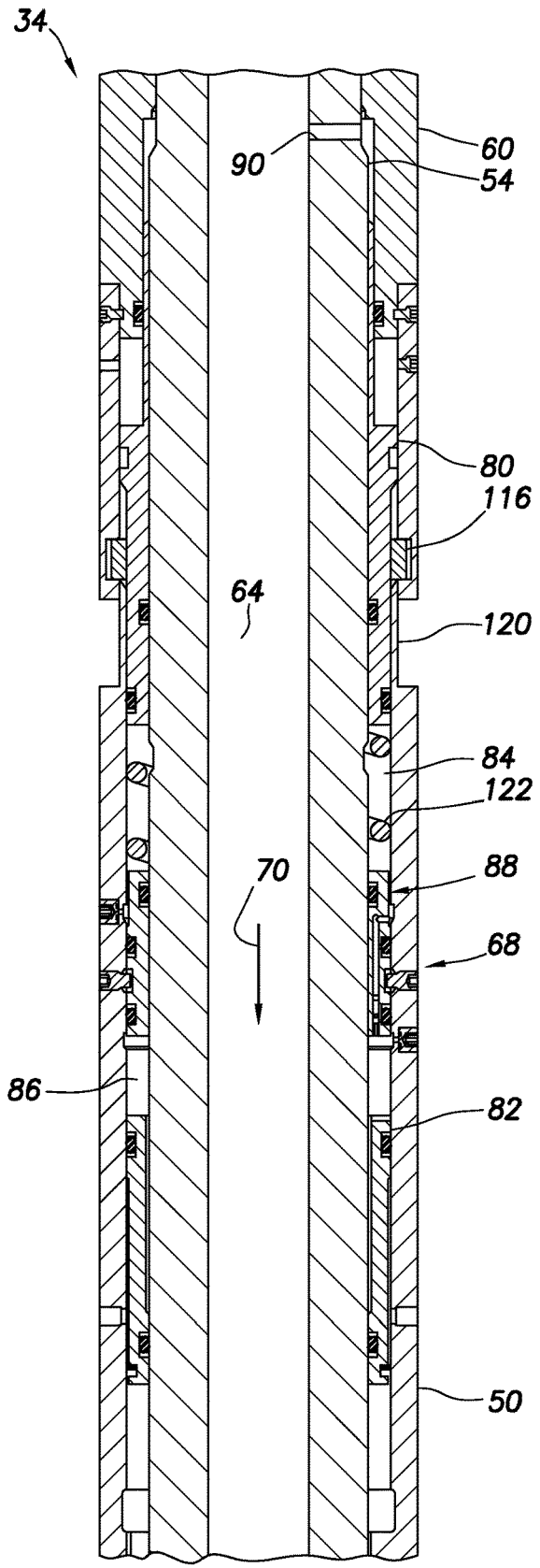

In FIG. 27, another pressure differential has been applied across the casing scraper 34. The pistons 82, 82, flow restrictor 88, chambers 84, 86, housings 48, and outer housing sections 50, 52 displace downward against the biasing force exerted by the spring 74. The downward displacement of the housings 48 relative to the mandrel 54 causes the scraper elements 44 to withdraw radially inward to the retracted configuration.

Figure 28:
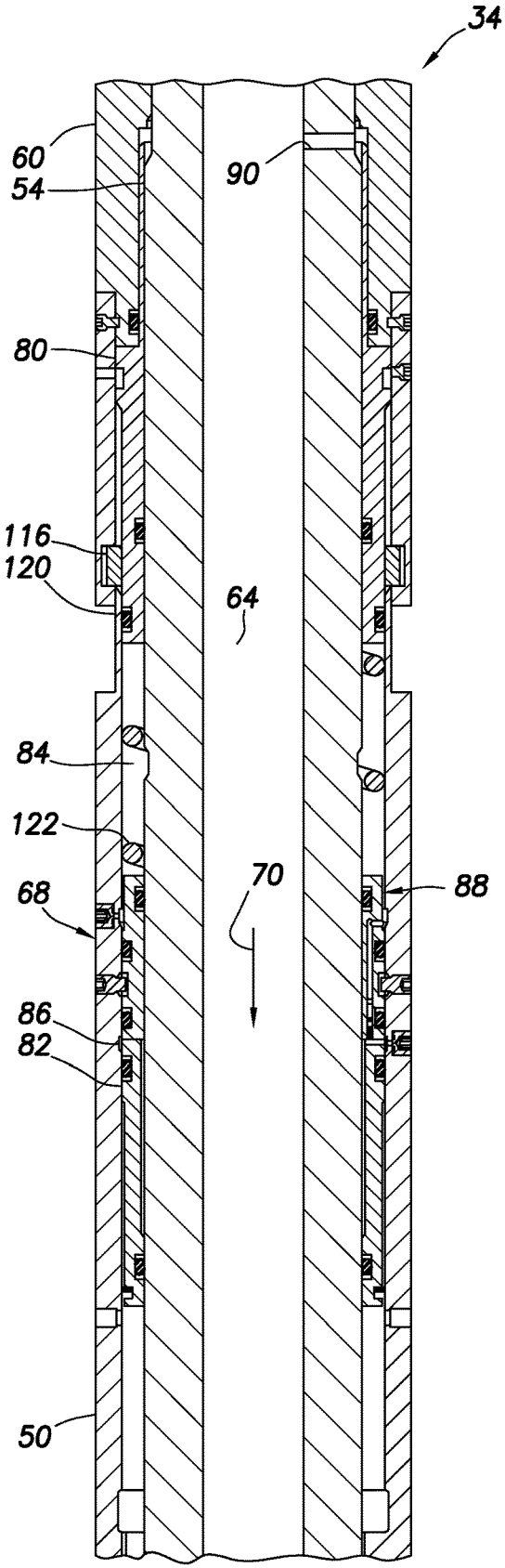

In FIG. 28, the spring 122 has gradually displaced the piston 80 upward to its initial locked position. The outer housing section 50 is now prevented from displacing upward (and the casing scraper 34 is thus, locked, in the retracted configuration) by the radially contracted snap ring 116. Note that the FIG. 28 retracted configuration is the same as the run-in retracted configuration of FIG. 24, except that the shear screw 114 has been sheared in the FIG. 28 configuration.

The shear screw 114 provides a positive, distinct predetermined pressure differential at which the piston 80 can begin displacing relative to the mandrel 54. However, use of the shear screw 114 is optional in all of the casing scraper 34 examples described herein. For example, the preload in the spring 74 can be used to prevent displacement of the piston 80 until a certain pressure differential level is achieved.

The flow restrictor 88 provides a delay in actuation of the casing scraper 34, so that transient or inadvertent pressure differential spikes will not result in actuation of the casing scraper 34. For example, in a drilling operation such as that depicted in FIGS. 1 & 2, a drilling motor connected in the tubular string 30 could stall, resulting in an unexpected spike in pressure differential across the casing scraper 34.

Unless the pressure differential remains at or above a predetermined level (e.g., sufficient to overcome the spring 74 preload) for at least a predetermined period of time (e.g., sufficient to transfer a given volume of fluid between the chamber 84, 86 via the flow restrictor 88), the casing scraper 34 will not be actuated by the actuator 68.

In examples described herein, the actuator 68 can extend or retract the scraper elements 44 by displacing the housings 48 and thereby permitting the springs 72 to extend, or preventing the springs from extending, the scraper elements toward the inner surface of a surrounding tubular. Thus, the terms "extend" and "retract" are used in this regard to refer to causing or initiating extension or retraction of the scraper elements 44, whether or not any intermediate elements are also needed to accomplish the extension or retraction. The scope of this disclosure is not limited to any particular manner, technique or configuration, number or combination of elements used for extending and retracting the scraper elements 44.

It may now be fully appreciated that significant advancements are provided by the above disclosure to the arts of constructing and operating casing scrapers for use in wells. In examples described above, the casing scraper 34 can be repeatedly extended and repeatedly retracted downhole, in any order and any number of times, as desired. This allows for cleaning an interior surface of a surrounding tubular, and not cleaning the interior surface, when and where desired, and before or after any other well operation.

The above disclosure provides to the arts a casing scraper 34 for use with a subterranean well. In one example, the casing scraper 34 can include one or more extendable scraper elements 44 configured to extend into cleaning contact with an interior surface of a casing 16 in the well, and an actuator 68 that extends the scraper elements 44 in the well after the actuator 68 retracts the scraper elements 44 in the well. The actuator 68 extends the scraper elements 44 and retracts the scraper elements 44 after application of respective pressure differentials in the well. As mentioned above, the actuator 68 may in some examples extend or retract the scraper elements 44 by displacing the housings 48 and thereby permitting the scraper elements 44 to contact, or preventing the scraper elements 44 from contacting, the interior surface of the casing 16.

The pressure differentials may be applied between an interior and an exterior of the actuator 68. If flow restriction in the tubular string 30 downstream of the casing scraper 34 is not sufficient to produce a desired pressure differential level at a given flow rate, the flow restriction can be increased (for example, by installing a plug or other restrictor in the flow passage 64 at or downstream of the actuator 68), or the flow rate can be increased.

The actuator 68 may include a metering device (such as the flow restrictor 88 and chambers 84, 86) that delays actuation of the casing scraper 34 in response to the pressure differentials. The metering device 84, 86, 88 may gradually transfer fluid through a restrictor element 110 that provides communication between fluid chambers 84, 86 of the actuator 68. The metering device 84, 86, 88 may permit actuation of the casing scraper 34 only after application of at least a predetermined pressure differential for at least a predetermined period of time.

The actuator 68 may retract the scraper elements 44 in the well after the actuator 68 extends the scraper elements 44 in the well. The actuator 68 may cycle the scraper elements between 44 extended and retracted configurations multiple times.

A method of operating a casing scraper 34 to clean an interior surface of a casing 16 in a well is also provided to the arts by the above disclosure. In one example, the method can include extending one or more scraper elements 44 of the casing scraper 34 into contact with the interior surface of the casing 16 in response to application of a first predetermined pressure differential applied between an interior and an exterior of the casing scraper 34, the first predetermined pressure differential being applied without obstructing an interior flow passage 64 formed longitudinally through the casing scraper 34; and then retracting the scraper elements 44 in response to release of a second predetermined pressure differential applied between the interior and the exterior of the casing scraper 34.

The first and second predetermined pressure differentials may be substantially the same, or they may be different. Either of the first and second predetermined pressure differentials may be greater or less than the other predetermined pressure differential.

The method may also include again extending the scraper elements 44 after the retracting step. The method may include repeating each of the extending and the retracting steps.

The extending step may include applying at least the first predetermined pressure differential for at least a predetermined period of time.

The method may include, after the retracting step, drilling into the earth with a tubular string 30, the casing scraper 34 being connected in the tubular string 30. The method may include, before the extending, drilling into the earth with a tubular string 30, the casing scraper 34 being connected in the tubular string 30 and, after the extending, cleaning the interior surface of the casing 16 by displacing the casing scraper 34 in the casing 16.

The extending step may include producing relative displacement between a follower 44*b* and an inclined surface 48*b*, each of the follower 44*b* and the inclined surface 48*b* being operably associated with a respective one of the scraper elements 44 and a scraper element housing 48.

A well system 10 is also described above. In one example, the well system 10 can include a casing scraper 34 connected in a tubular string 30 disposed in a casing 16, the casing scraper 34 including one or more extendable scraper elements 44, and an actuator 68 that operates in response to manipulation of pressure differentials applied between an interior and an exterior of the tubular string 30; and a cutting tool 32 connected at a distal end of the tubular string 30. Fluid 70 flows through the casing scraper 34 and through the cutting tool 32 as the pressure differentials are applied.

The actuator 68 may extend the scraper elements 44 in the well after the actuator 68 retracts the scraper elements 44 in the well. The actuator 68 may retract the scraper elements 44, after a predetermined pressure differential is applied with the fluid 70 flowing through the cutting tool 32.

The actuator 68 may operate the casing scraper 34 only in response to application of at least a predetermined pressure differential applied for at least a predetermined period of time.

The actuator 68 may include an index mechanism 94 that permits repeated cycling of the casing scraper 34 between retracted and extended configurations.

The actuator 68 may retract the scraper elements 44 while a longitudinal flow passage 64 formed through the casing scraper 34 remains unobstructed.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A casing scraper for use with a subterranean well, the casing scraper comprising:

one or more extendable scraper elements configured to extend into cleaning contact with an interior surface of a casing in the well; and an actuator that extends the scraper elements in the well after the actuator retracts the scraper elements in the well, in which the actuator extends the scraper elements and retracts the scraper elements after application of respective pressure differentials in the well, and in which the actuator comprises a metering device that delays actuation of the casing scraper in response to the pressure differentials.

2. The casing scraper of claim 1, in which the pressure differentials are applied between an interior and an exterior of the actuator.

3. The casing scraper of claim 1, in which the metering device gradually transfers fluid through a restrictor element that provides communication between fluid chambers of the actuator.

4. The casing scraper of claim 1, in which the metering device permits actuation of the casing scraper only after application of at least a predetermined pressure differential for at least a predetermined period of time.

5. The casing scraper of claim 1, in which the actuator retracts the scraper elements in the well after the actuator extends the scraper elements in the well.

6. The casing scraper of claim 1, in which the actuator cycles the scraper elements between extended and retracted configurations multiple times.

7. A method of operating a casing scraper to clean an interior surface of a casing in a well, the method comprising:

applying at least a first predetermined pressure differential for at least a predetermined period of time between an interior and an exterior of the casing scraper, in which the first predetermined pressure differential is applied without obstructing an interior flow passage formed longitudinally through the casing scraper, and in which the predetermined period of time is regulated by a metering device within the casing scraper;

extending one or more scraper elements of the casing scraper into contact with the interior surface of the casing in response to the application of the first predetermined pressure differential for the predetermined period of time; and then retracting the scraper elements in response to release of a second predetermined pressure differential applied between the interior and the exterior of the casing scraper.

8. The method of claim 7, further comprising again extending the scraper elements after the retracting.

9. The method of claim 7, further comprising repeating each of the extending and the retracting.

10. The method of claim 7, further comprising, after the retracting, drilling into the earth with a tubular string, the casing scraper being connected in the tubular string.

11. The method of claim 7, further comprising:

before the extending, drilling into the earth with a tubular string, the casing scraper being connected in the tubular string; and after the extending, cleaning the interior surface of the casing by displacing the casing scraper in the casing.

12. The method of claim 7, in which the first and second predetermined pressure differentials are substantially the same.

13. The method of claim 7, in which the extending comprises producing relative displacement between a follower and an inclined surface, each of the follower and the inclined surface being operably associated with a respective one of the scraper elements and a scraper element housing.

14. A well system, comprising:

a casing scraper connected in a tubular string disposed in a casing, the casing scraper including one or more extendable scraper elements, and an actuator that operates in response to manipulation of pressure differentials applied between an interior and an exterior of the tubular string; and in which the actuator operates the casing scraper only after at least a predetermined pressure differential has been applied between the interior and the exterior of the tubular string for at least a predetermined period of time, and in which the predetermined period of time is regulated by a metering device within the casing scraper.

15. The well system of claim 14, in which the actuator extends the scraper elements in the well after the actuator retracts the scraper elements in the well.

16. The well system of claim 14, in which fluid flows through the casing scraper and through a cutting tool as the pressure differentials are applied.

17. The well system of claim 16, in which the actuator retracts the scraper elements, after the predetermined pressure differential is applied with the fluid flowing through the cutting tool.

18. The well system of claim 14, in which the actuator comprises an index mechanism that permits repeated cycling of the casing scraper between retracted and extended configurations.

19. The well system of claim 14, in which the actuator retracts the scraper elements while a longitudinal flow passage formed through the casing scraper remains unobstructed.

* * * * *